US006568436B1

(12) United States Patent
Matthews et al.

(10) Patent No.: US 6,568,436 B1
(45) Date of Patent: May 27, 2003

(54) SYSTEM FOR PERIODIC FLUID MAINTENANCE OF APPARATUS

(75) Inventors: John H. Matthews, Cummings, GA (US); L. William Silzle, Marietta, GA (US); John R. Martin, Concord Township, OH (US); Albert L. Ruff, Lawrenceville, GA (US); Gary E. Gerber, Alpharetta, GA (US); Frederick P. Boyle, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 11 days.

(21) Appl. No.: 09/729,512

(22) Filed: Dec. 4, 2000

(51) Int. Cl.[7] ..... B65B 1/04

(52) U.S. Cl. ..... 141/65; 141/98; 141/192; 184/1.5

(58) Field of Search ..... 141/65, 59, 98, 141/192, 198, 95; 184/1.5; 701/29–33; 340/603, 606, 612, 618–625, 631; 123/196 R

(56) References Cited

U.S. PATENT DOCUMENTS

| | | | | |
|---|---|---|---|---|
| 3,621,938 A | | 11/1971 | Beattle | 184/7 |
| 3,866,624 A | | 2/1975 | Peterson | 137/234.6 |
| 4,847,768 A | | 7/1989 | Schwartz et al. | 364/424 |
| 4,949,070 A | * | 8/1990 | Wetzel | 184/108 |
| 4,967,882 A | | 11/1990 | Meuer et al. | 184/7.4 |
| 5,159,313 A | * | 10/1992 | Kawai et al. | 123/196 S |
| 5,203,429 A | | 4/1993 | Zager | 184/1.5 |
| 5,273,085 A | | 12/1993 | Edwards et al. | 141/83 |
| 5,749,339 A | | 5/1998 | Graham et al. | 123/73 |
| 5,787,372 A | | 7/1998 | Edwards et al. | 701/29 |
| 5,819,201 A | | 10/1998 | DeGraaf | 701/208 |
| 5,885,940 A | | 3/1999 | Sumimoto | 508/111 |
| 5,964,318 A | | 10/1999 | Boyle et al. | 184/1.5 |
| 6,123,174 A | | 9/2000 | Elkin et al. | 184/1.5 |
| 6,302,167 B1 | | 10/2001 | Hollub | 141/98 |

FOREIGN PATENT DOCUMENTS

| | | |
|---|---|---|
| DE | 4429317 A1 | 4/1995 |
| WO | WO99/24725 | 5/1999 |

* cited by examiner

*Primary Examiner*—Steven O. Douglas
(74) *Attorney, Agent, or Firm*—Teresan W. Gilbert; Michael F. Esposito; David M. Shold

(57) ABSTRACT

A system for periodically maintaining non-fuel fluids required for proper performance by various apparatus and for reporting non-fuel fluid maintenance action taken. Maintenance systems include means for replacing, replenishing or renewing non-fuel fluids or renewing non-fuel fluid filters. Reporting systems include means for communicating information between on- and off-apparatus sub-systems and for generating reports that document non-fuel fluid maintenance actions taken.

58 Claims, 18 Drawing Sheets

SYSTEM FOR PERIODIC FLUID MAINTENANCE OF APPARATUS

FIELD OF THE INVENTION

The present invention relates to a system for periodically maintaining non-fuel fluids required for proper performance by various industrial and transportation devices such as manufacturing equipment and on- or off-highway vehicles and the like (hereafter collectively referred to as "apparatus"). More specifically, this invention relates to a cost effective system for maintaining non-fuel fluids (hereafter "fluids") that are lost, consumed or deteriorate during apparatus use. The system can further record and report fluid condition and maintenance performed in a manner that can allow failed or failing apparatus systems or components to be identified and repairs to be scheduled, that can certify the apparatus' regulatory compliance, that can allow apparatus, apparatus sub-system, or apparatus operator performance to be optimized, or that can allow managing the cost of apparatus operation.

BACKGROUND OF THE INVENTION

Periodic fluid maintenance is essential for the proper operation and long service life of various apparatus. Fluid maintenance can include for example monitoring fluid levels such as engine oil, gear oils, chassis lubricant, coolant, windshield washer, brake and tire-air, replenishment of consumed or lost fluids, replacement of used fluids, and renewal of maintenance items/components such as cleaning fluid filters for improved apparatus performance and/or longer apparatus life. As used herein, "fluid(s)" or "maintenance fluid(s)" means any non-fuel fluid that can flow through a conduit including liquids, gases, semi-solids, electric current and fine particulates. Examples of liquids are engine oil, grease lubricant, metalworking fluid, hydraulic fluid, coolant, transmission fluid, brake fluid, and cleaning fluid. Examples of gases are air, nitrogen, oxygen, carbon dioxide and refrigerant. Examples of semi-solids are greases. Examples of fine particles are abrasives.

These periodic maintenance requirements are considered by most to be, at the very least, an inconvenience, and more typically, an unwanted burden of apparatus operation or ownership that add significantly to operating costs. Costs incurred are both direct, (e.g., labor, records keeping and materials, including any waste disposal, of the maintenance process) and indirect (e.g., lost productivity while the apparatus is being maintained). In addition to being an unwanted burden to the apparatus owner or operator, maintenance items associated with fluids can be an environmental burden if the owner or operator does not properly dispose of the used fluids.

A variety of methods and systems have been disclosed that attempt to minimize the fluid maintenance burden. One approach is to simply provide the apparatus operator or maintenance provider with a better diagnosis of when maintenance is required. For transportation apparatus, U.S. Pat. No. 4,847,768, Schwartz et al., July 1989, discloses a system and method for indicating the remaining useful life of engine oil during engine operation based on engine operating parameters. U.S. Pat. No. 5,819,201, DeGraaf, October 1998, discloses a navigation system that displays service reminders at user-defined intervals, and directions to a vehicle service location. A limitation of simply providing information as to when to perform the maintenance is that this alone does little to relieve the burden of actually performing the maintenance.

Another approach to minimizing the fluid maintenance burden is the use of off-apparatus methods and systems to reduce the time or the inconvenience of the fluid maintenance operations. For transportation apparatus, U.S. Pat. No. 3,866,624, Peterson, February 1975, discloses a gasoline service lane for a gas station with a recessed service pit that allows a service technician to perform work under the vehicle while the vehicle is being refueled. U.S. Pat. No. 5,787,372, Edwards et al., July 1998, discloses an automated system for evacuating used fluid from a fluid receptacle, such as the oil sump of an internal combustion engine, and replenishing with fresh fluid. U.S. Pat. No. 5,885,940, Sumimoto, March 1999, discloses a method for total or partial exchange of lubricant oil when a vehicle stops at a gas station for refueling. Stand-alone quick oil-change facilities also fall into this category of off-apparatus methods and systems. Known art in this off-apparatus approach, in general, reduces the time and, in some cases, the inconvenience of apparatus fluid maintenance. These off-apparatus service methods and systems, however, do not remove the operator or service technician burden of scheduling time for when the fluid maintenance is to be performed. Nor do they provide a convenient means of tracking and recording the fluid maintenance details for individual apparatus that have fluid maintenance performed at a multitude of locations during the apparatus' operational life.

Another approach to minimizing the fluid maintenance burden is the use of on-apparatus methods and systems. U.S. Pat. No. 4,967,882, Meuer et al., November 1990, discloses a central lubricating installation that automatically lubricates components at regular intervals and varies the pumping time per each grease application based on the starting current of the pump motor. For transportation apparatus, U.S. Pat. No. 5,749,339, Graham et al., May 1998, discloses an on-apparatus method and system for automatically replacing an engine's used lubricating oil with fresh oil during engine operation based on operating conditions. U.S. Pat. No. 5,964,318, Boyle et al., October 1999, discloses a system and method for sensing the quality of an engine's lubrication oil to diagnose potential engine failure and to automatically replace used oil with fresh oil to maintain oil quality.

While on-apparatus approaches potentially offer the best solution to fluid maintenance burdens, these systems also create other ownership burdens. On-apparatus systems have relatively high cost and, particularly those that maintain fluids, can have large space requirements for reservoirs, pumps and other needed equipment. This creates the burden of substantially higher apparatus cost, which may be acceptable for mission critical or high-value apparatus, but is unacceptable or not practical for many apparatus. In addition, for on-apparatus fluids maintenance systems, maintenance is not fully eliminated, since the operator or service technician must still fill fresh fluid reservoirs and, in some cases, empty used fluid reservoirs on a regular basis.

Another approach to minimizing the fluid maintenance burden that reduces the cost and space requirements of on-apparatus solutions is the use of on-apparatus/off-apparatus methods and systems. This approach places most of the costly and bulky fluid maintenance equipment in a central location that services a multitude of apparatus, and places only apparatus-specific fluid maintenance equipment on the individual apparatus. For transportation apparatus, U.S. Pat. No. 3,621,938, Beattie, November 1971, discloses a lubricating system for applying grease to apparatus using an off-apparatus pump and reservoir that connects at a single point to an on-apparatus network that distributes the grease to individual components. The Beattie invention, however, does not determine the precise amount of grease to apply to individual apparatus, nor does the system record how much grease is applied.

Further for transportation apparatus, U.S. Pat. No. 2,966,248, Armbruster, December 1960, discloses a system with an on-apparatus general supply port that allows the apparatus operator, in one operation, to purchase fuel and engine oil and to receive other maintenance fluids such as air, water, distilled water, and grease for free. This system also provides for charging the apparatus' battery during fluid purchase, and automatically photographing the apparatus' license numbers to record apparatus use of the system. While this system provides the convenience of replenishing apparatus fluids in one location, the system does not allow for determining fluid quality, maintaining fluid quality by exchanging maintenance fluids for used fluids, renewing fluid filters, and documenting and reporting the actual fluid maintenance provided.

The known prior art, either alone or in combination, does not provide a complete, cost-effective fluid maintenance system that automatically determines when fluid maintenance is required, determines and controls the fluid maintenance process, and records and reports the fluid/apparatus condition and fluid maintenance actions performed. The prior art has not changed the current fluid maintenance paradigm in a manner that significantly reduces the overall apparatus ownership inconvenience and burden.

SUMMARY OF THE INVENTION

The present invention relates to a cost-effective system that allows apparatus fluid maintenance to occur automatically with minimal effort and time, to reduce the inconvenience and burden of the owner or maintenance provider.

One feature of the invention is that only one fluid can be maintained or a multitude of fluids can be maintained at the same time by the system.

Another feature of the invention is that if multiple fluids are communicated between on-apparatus components and off-apparatus components of the system at an off-apparatus fluid maintenance facility, the system can have either one apparatus fluid communication port or multiple apparatus fluid communication ports.

Another feature of the invention is that information related to the fluid condition and maintenance actions taken can be recorded by a controller.

Another feature of the invention is that information related to the fluid condition and maintenance actions taken can be reported by the controller in a manner that can be used in a variety of ways, for example:

- to schedule a repair/maintenance that is not provided at the off-apparatus fluid maintenance facility;
- to provide data to a service provider to optimize apparatus, apparatus sub-system or operator performance;
- to provide manufacturers a maintenance history of apparatus components or sub-systems returned for warranty repair or replacement;
- to provide manufacturers real-world performance and maintenance information for optimizing apparatus component or sub-system design and manufacture;
- to allow complete analysis of apparatus operation cost;
- to alert a regulatory enforcement agency if the apparatus, or an apparatus component or sub-system is out of compliance.

Another feature of the invention is that the fluid maintenance can be tailored to the needs of the individual apparatus or of the individual apparatus owner or operator.

Another feature of the invention is that only those on-apparatus fluid maintenance sub-systems/components are included that can be cost justified, based on a real-time operator or service-provider need-to-know, or that are apparatus specific for sensing and/or for communicating information or fluids used.

Another feature of the invention is that the majority of the costly and bulky sub-systems/components for fluid maintenance is located offapparatus (e.g., at a fixed fluid maintenance facility where the apparatus is brought for fluid maintenance, etc. or a mobile fluid maintenance facility that is brought to the location of the apparatus for fluid maintenance, etc.) for use by a multitude of apparatus to reduce per-apparatus cost.

Another feature of the invention is that the off-apparatus fluid maintenance sub-systems/components of the system can be placed in a controlled, less harsh, operating environment with easier serviceability than if the sub-systems/components were mounted on the apparatus.

Another feature of the invention is that off-apparatus maintenance sub-systems/components of the system can replenish or replace apparatus fluids to maintain the quality or level of the fluids.

Another feature of the invention is that the system can renew contaminant removal components, such as filters, by backflushing either with used fluids as they are removed during the maintenance operation, or with specific cleaning or renewing fluids to maintain the operation of the contaminant removal components.

Another feature of the invention is that all apparatus fluid maintenance is handled at an off-apparatus fluid maintenance facility where proper fluid handling practices are easy to control and include used fluid disposal, thus minimizing potential hazard for the environment.

The foregoing and other aspects and features of the invention will become apparent from the following description made with reference to the drawings.

BRIEF DESCRIPTION OF THE DRAWING FIGURES

Figure 16A:
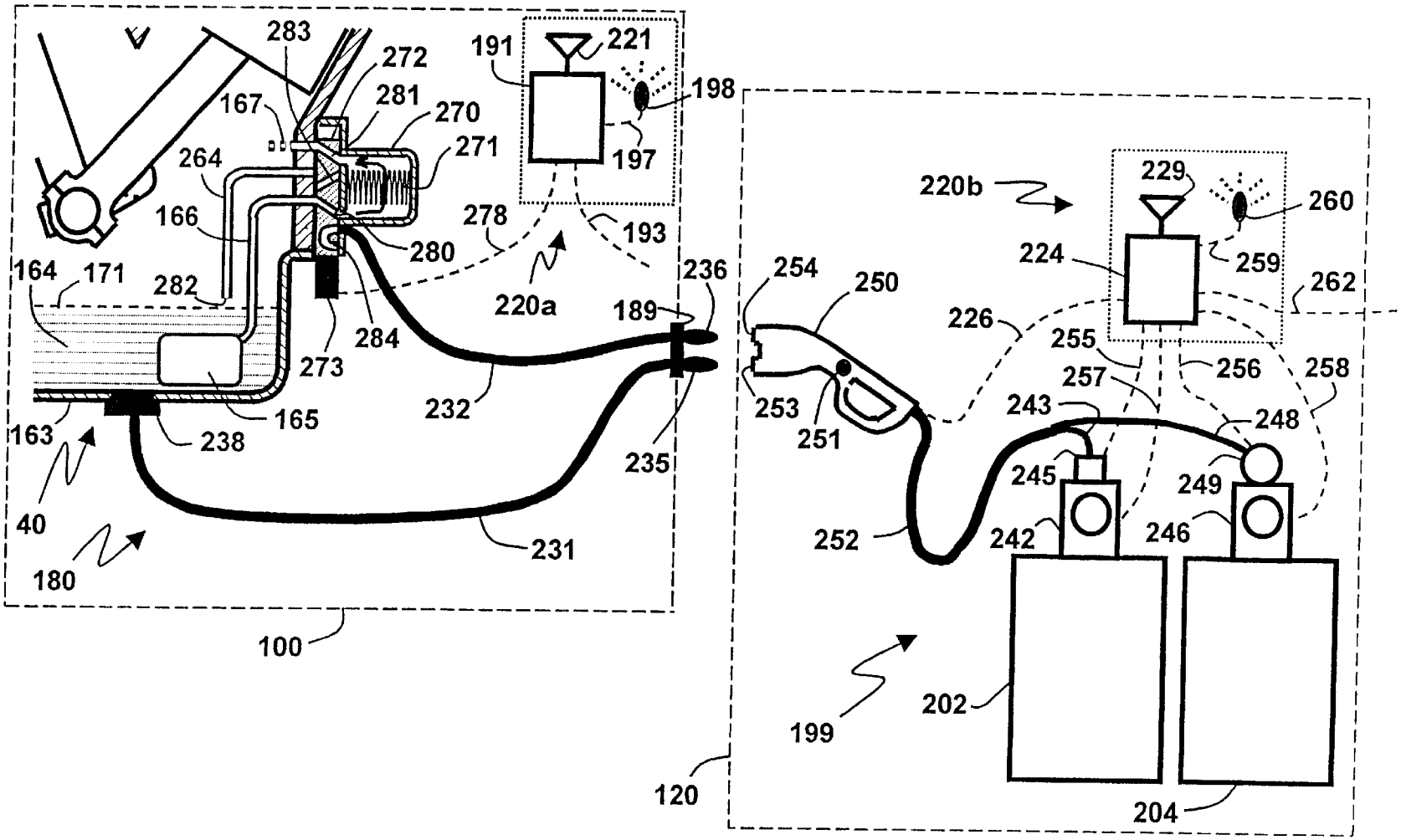
Figure 16B:
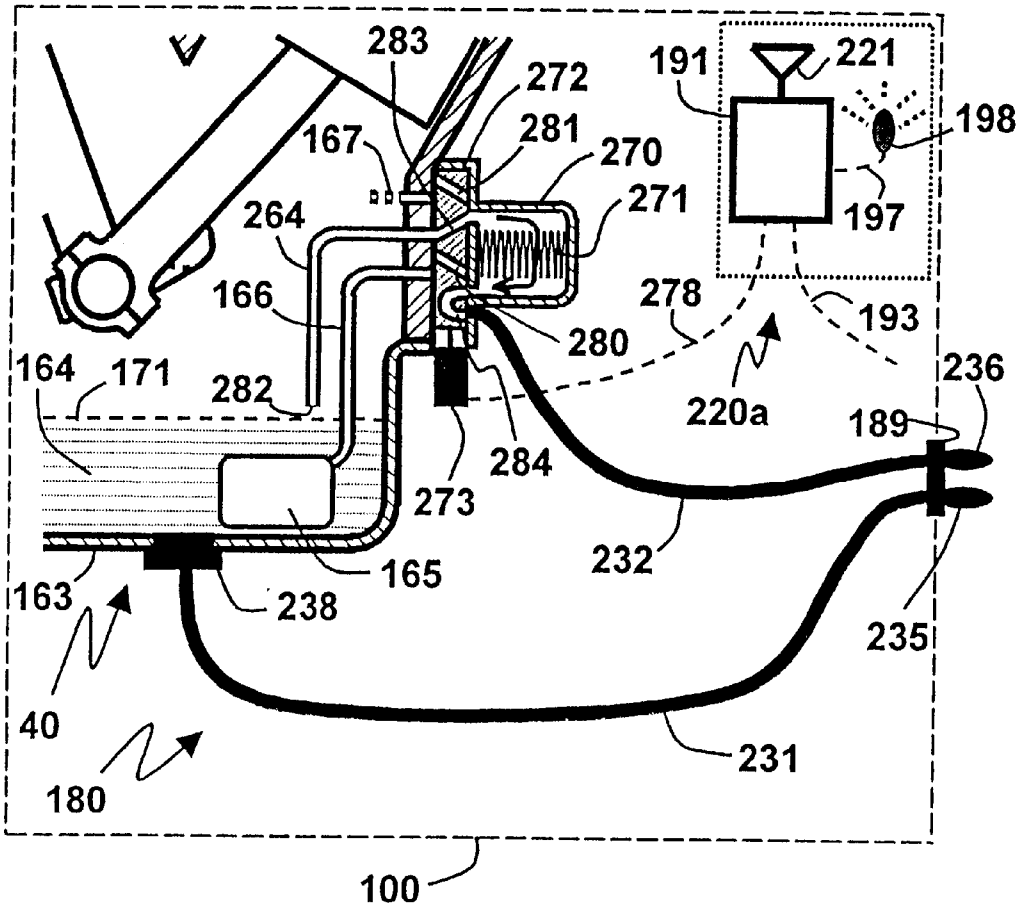

FIGS. 16*a* and 16*b* are schematic illustrations of another invention embodiment for periodically maintaining engine oil which includes backflushing the engine oil filter to renew the filter.

Figure 17A:
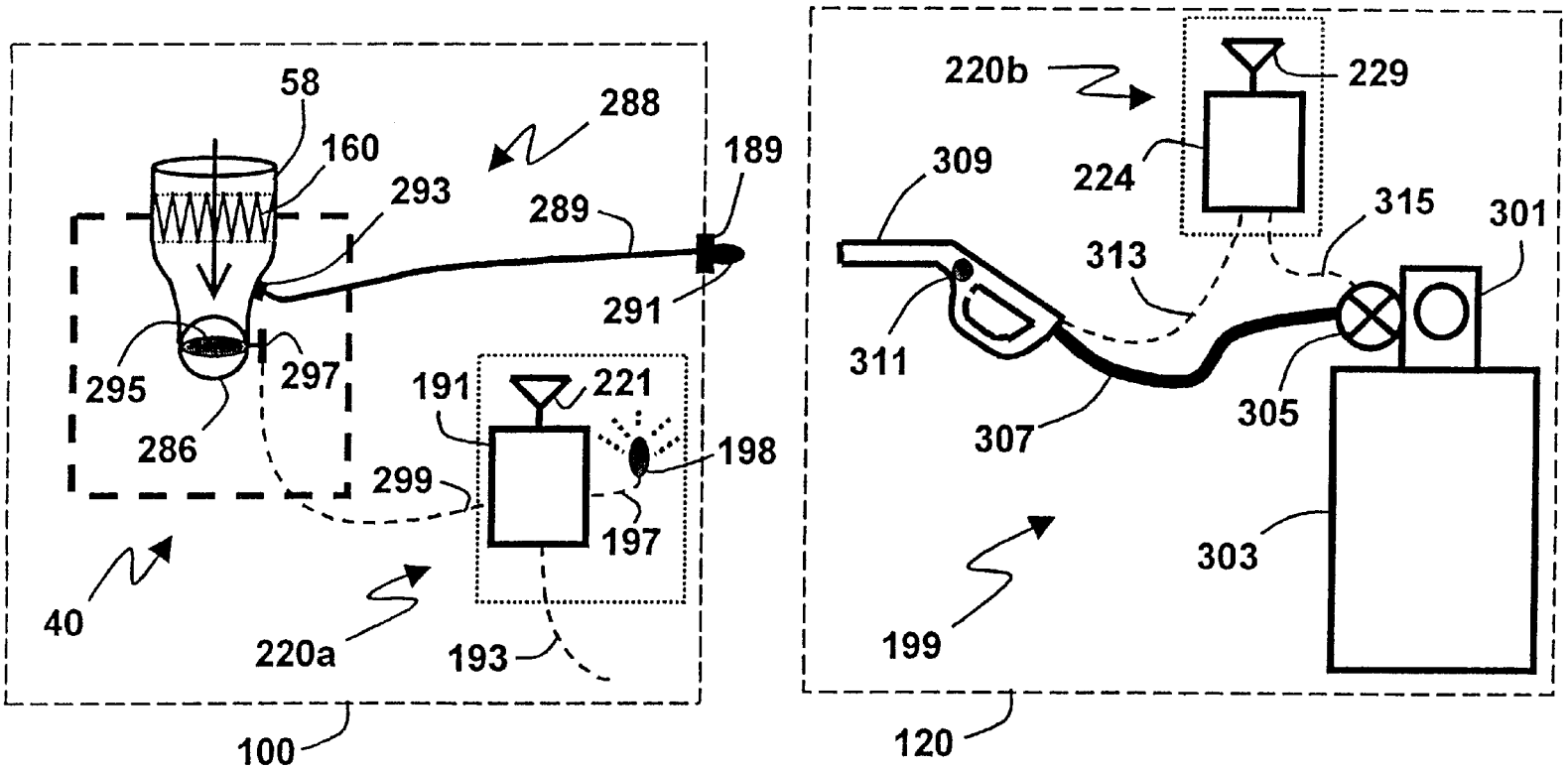
Figure 17B:
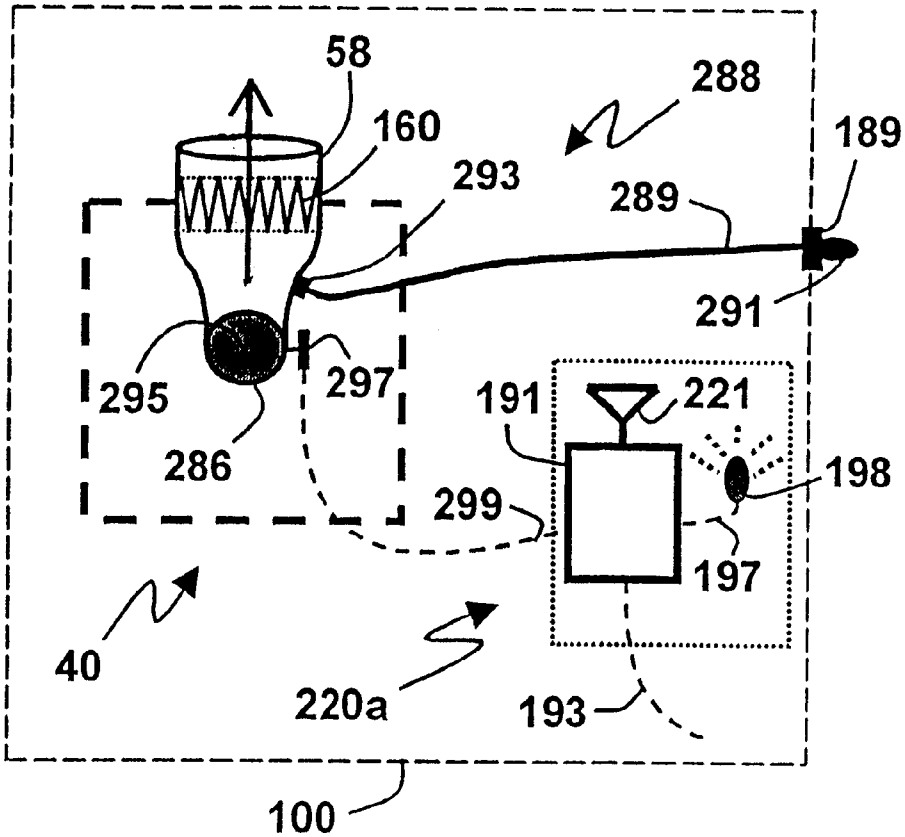

FIGS. 17*a* and 17*b* are schematic illustrations of another invention embodiment for periodically maintaining an engine's intake air by backflushing an engine's air filter to renew the filter.

Figure 18:
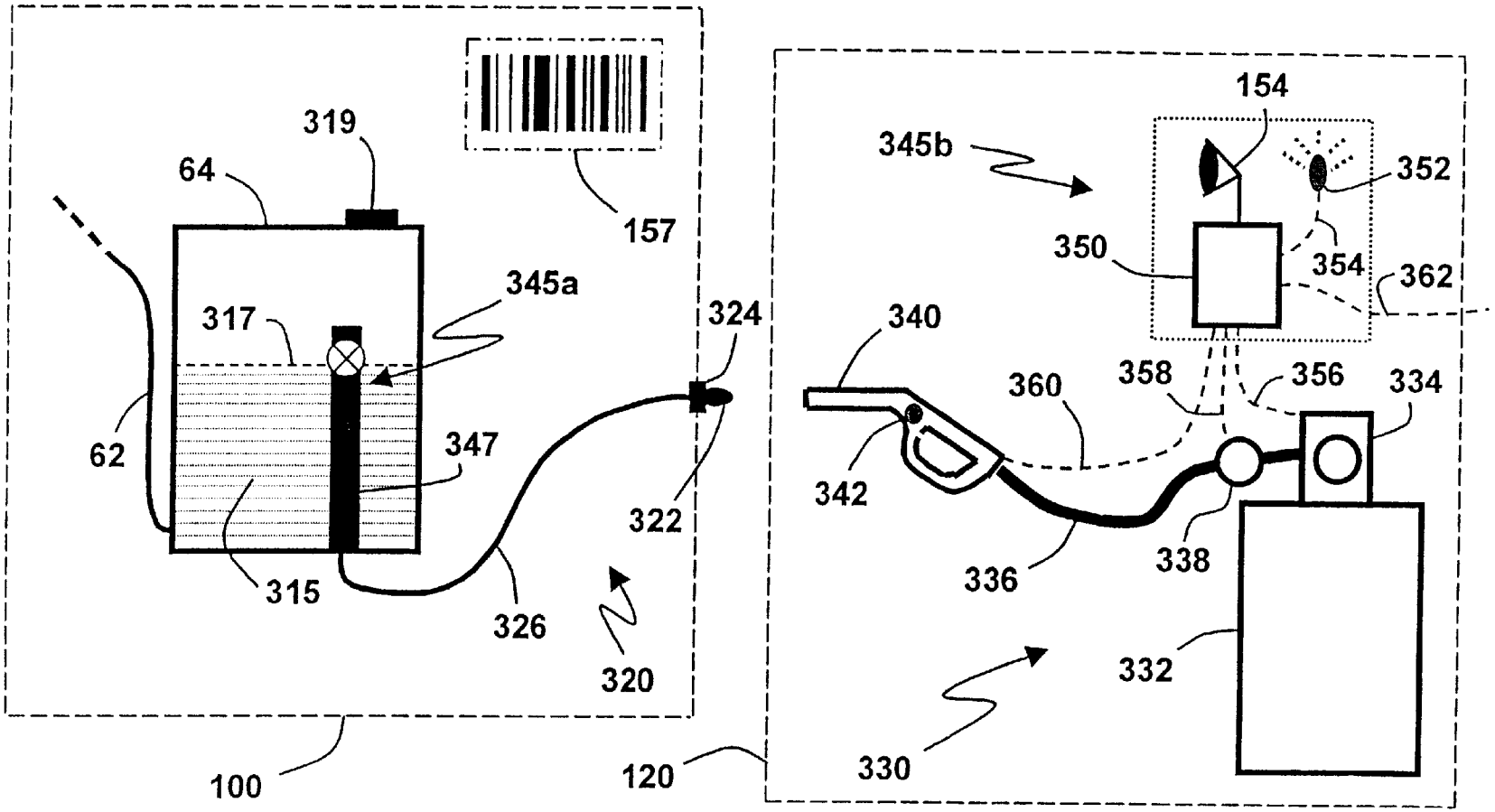

FIG. 18 is a schematic illustration of another invention embodiment for periodically maintaining an engine's coolant level.

DETAILED DESCRIPTION OF THE INVENTION

The present invention relates to a system for periodically maintaining the quality and/or level of any non-fuel fluid (hereafter "fluids") that is consumed, lost or used in an industrial or transportation apparatus thereby maintaining the performance and/or extending the life of such apparatus. In general, any apparatus that consumes, loses or uses fluids can have fluids maintained by the systems of this invention. The invention uses maintenance fluids to maintain the fluids of an apparatus or an apparatus component/sub-system. The maintenance fluids may be essentially the same as fluids already contained by the apparatus, or may be specially formulated for the maintenance application. For example, the maintenance fluid may have at least one additive that improves the fluid performance of the apparatus fluid. Examples of such performance additive are: corrosion inhibitor, viscosity modifier, dispersant, friction modifier, coolant inhibitor, surfactant, detergent, and extreme pressure agent. For the purposes of illustration, the following embodiments are shown and described.

Figure 1:
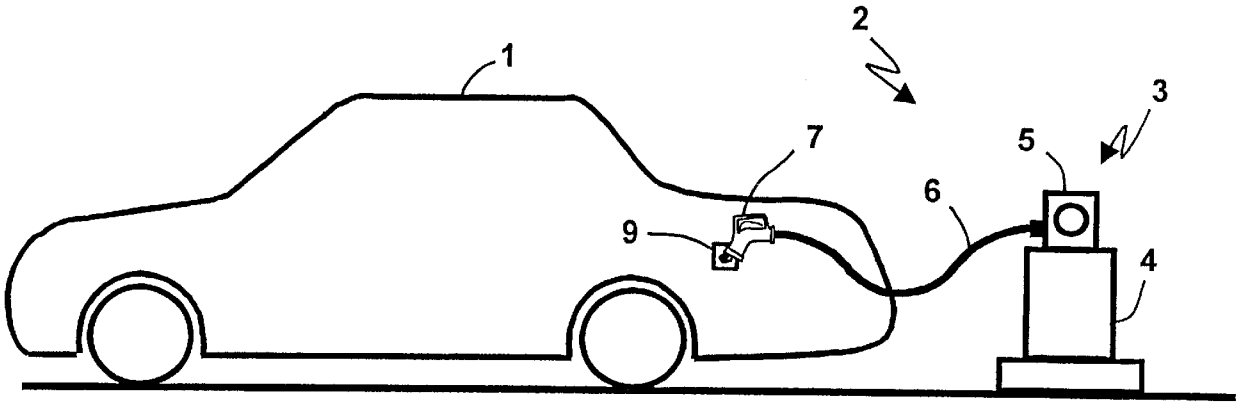
FIG. 1 is a schematic illustration of one embodiment of the present invention including an off-apparatus sub-system at a fluid maintenance facility with fluid pump, reservoir, and single hose/nozzle for fluid communication with the port of an apparatus.

FIG. 1 shows one embodiment of the invention where transportation apparatus 1, such as a passenger vehicle or heavy-duty highway truck, is at a fixed fluid maintenance facility 2 to have maintained a non-fuel fluid that is consumed, lost or deteriorated by apparatus 1. Fluid maintenance facility 2 has an off-apparatus sub-system 3 that includes maintenance fluid reservoir 4 and fluid pump 5 for storing and pumping maintenance fluid. For example reservoir 4 may contain grease that is used to lubricate chassis components on apparatus 1. Off-apparatus sub-system 3 at fluid maintenance facility 2 also includes hose 6 that communicates fluid and information between the pump 5 and nozzle 7 which mates with connector(s) (not shown) of port 9. The connector(s) at port 9 are part of an on-apparatus sub-system (not shown) that communicates the maintenance fluid from the connectors to apparatus components with the fluid that is being maintained. If apparatus 1 requires periodic refueling, port 9 can be the same location as the traditional refueling port of apparatus 1 wherein nozzle 7 mates with connector(s) that is (are) separate from the connector for the traditional refueling nozzle. Port 9 can also be at a location that is separate of any refueling port.

In operation, periodically, when fluid maintenance is required or desired for apparatus 1, the apparatus is brought to fluid maintenance facility 2 and nozzle 7 of off-apparatus sub-system 3 is mated to the connector(s) at port 9. A control means (not shown) determines the quantity of maintenance fluid required to maintain the quality and/or level of the non-fuel fluid in apparatus 1, and controls pump 5 to pump the determined quantity of maintenance fluid from reservoir 4 through hose 6 and nozzle 7 into the on-apparatus sub-system. The quantity of maintenance fluid is determined by the control means based on one or more fluid condition, apparatus use and/or apparatus condition inputs to the control means. Apparatus condition inputs can include performance and/or safety related variables.

At the completion of fluid transfer the control means can if desired record and/or provide a report of maintenance information. Maintenance information can include one or more of the following: fluid maintenance date, fluid maintenance location, fluid maintenance cost, fluid condition input(s), apparatus use input(s), apparatus condition input (s), measured or diagnosed fluid or apparatus condition(s) based on inputted or sensed inputs, fluid volume and type communicated during maintenance, or any additional inputs received by the control means during the fluid maintenance process. The maintenance information can include warning if measured or diagnosed fluid or apparatus conditions are outside determined or inputted ranges, and can include certification if measured or diagnosed fluid or apparatus conditions are within determined or inputted ranges. At the end of the maintenance process, apparatus 1 departs fluid maintenance facility 2, which is then prepared to service another apparatus with the appropriate on-apparatus sub-system.

Figure 2:
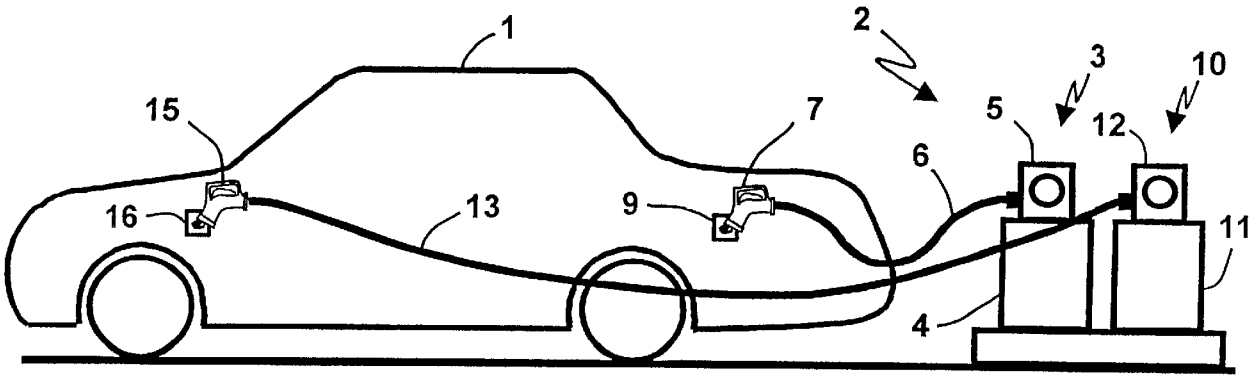
FIG. 2 is a schematic illustration of another invention embodiment including multiple off-apparatus sub-systems at a fluid maintenance facility with fluid pumps, reservoirs and multiple hoses each having nozzles for communicating with multiple ports of an apparatus.

FIG. 2 shows another embodiment of the invention where transportation apparatus 1 is having fluid maintenance at a fixed fluid maintenance facility 2. Fluid maintenance facility 2 includes a multitude of off-apparatus sub-systems 3, 10 including fluid reservoirs 4, 11 and fluid pumps 5 and 12 respectively (two of which are shown by way of example) that can either store and pump maintenance fluids to apparatus 1 or pump and receive used fluids from apparatus 1. For example, reservoir 4 may contain maintenance engine oil fluid and reservoir 11 may be for storing used engine oil. Off-apparatus sub-systems 3, 10 also include hoses 6, 13 that communicate fluid between pumps 5 and 12 and nozzles 7 and 15 respectively. Nozzle 7 mates to connector(s) (not shown) of an on-apparatus sub-system (not shown) at port 9, and nozzle 15 mates to connector(s) (not shown) of an on-apparatus sub-system (not shown) at port 16 on apparatus 1.

In operation, periodically, when fluid maintenance is required or desired, apparatus 1 is brought to fluid maintenance facility 2, nozzles 7 and 15 are mated to corresponding connectors at the ports 9 and 16 respectively of apparatus 1, and one or more control means (not shown) determine the quantity of maintenance fluids required to maintain quality and/or level of fluids in apparatus 1, and control pumps 5 and 12 to pump the determined quantities of the appropriate maintenance fluids to or used fluids from the on-apparatus sub-systems. At the completion of transferring all fluids, the control means can, if desired, record and/or provide a report of maintenance information. At the end of the maintenance process, nozzles 7 and 15 are removed from ports 9 and 16 respectively, and apparatus 1 departs fluid maintenance facility 2, which is then prepared to service another apparatus with appropriate on-apparatus sub-systems.

It should be noted that fluid maintenance facility 2 may have a greater number of off-apparatus sub-systems than can be used by any particular apparatus 1 since some apparatus may require maintenance of different fluids or a greater number of fluids than other apparatus. In this embodiment, the nozzles (7, 15 in this example) for the individual fluids maintained at fluid maintenance facility 2 can be designed to prevent the connection of inappropriate nozzles to connectors of the fluid maintenance sub-systems on apparatus 1.

The FIG. 2 embodiment has the inconvenience of making multiple connections between off-apparatus sub-systems at fluid maintenance facility 2 and the on-apparatus sub-systems of apparatus 1 to maintain the apparatus' fluids. The system of the present invention, however, does not require separate hoses and nozzles for each fluid.

Figure 3:
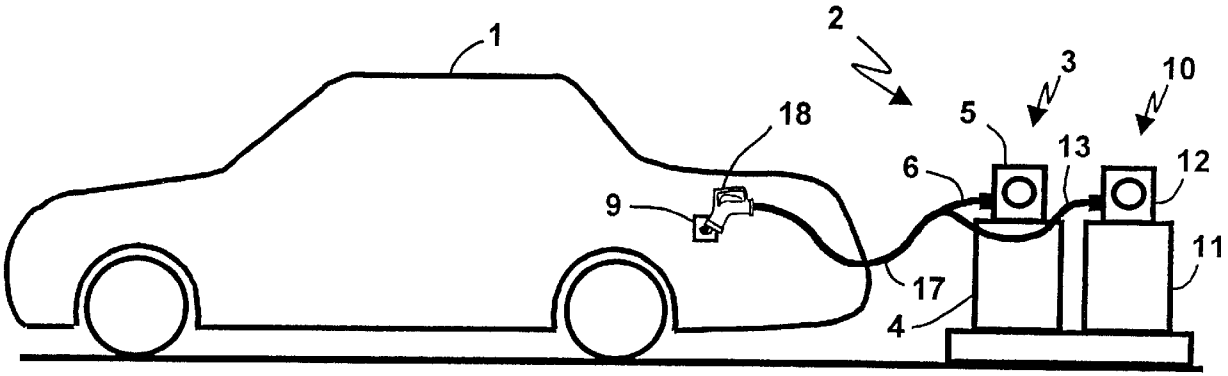
FIG. 3 is a schematic illustration of another invention embodiment which is similar to FIG. 2 except that the multiple hoses from the fluid pumps merge into a single hose having a nozzle with a multitude of connectors for communicating with corresponding connectors at a single port of an apparatus.

FIG. 3 shows an embodiment that is similar to the embodiment of FIG. 2, with multiple off-apparatus sub-systems 3, 10 (two of which are shown by way of example) for either storing and pumping maintenance fluids to apparatus 1 or pumping and receiving used fluids from apparatus 1. In this embodiment the hoses 6 and 13 of the individual sub-systems 3, 10 merge into a single hose 17 with a multitude of fluid and information communication conduits. Hose 17-terminates at nozzle assembly 18 that has a multitude of connectors (not shown) that connect to corresponding connectors (not shown) of on-apparatus fluid maintenance sub-systems (not shown) at port 9.

In operation, periodically when fluid maintenance is required or desired for apparatus 1, the apparatus is brought to fluid maintenance facility 2. The connectors of nozzle assembly 18 are mated to the connectors at port 9 in a manner that assures the communication of the proper fluids and information between the on-apparatus sub-systems on apparatus 1 and fluid reservoirs 4 and 11 of the off-apparatus sub-systems 3, 10 at fluid maintenance facility 2. One or more control means (not shown) determine the quantities of maintenance fluids required to maintain quality and/or level of fluids in apparatus 1, and control pumps 5 and 12 to pump the determined quantities of the appropriate maintenance fluids to or used fluids from the on-apparatus sub-systems. At the completion of transferring all fluids, the control means can, if desired, record and/or provide a report of maintenance information. At the end of the maintenance process, nozzle assembly 18 is removed from port 9, and apparatus 1 departs fluid maintenance facility 2, which is then prepared to service another apparatus with appropriate on-apparatus sub-systems.

It should be noted that apparatus 1 can have a fewer number of connectors at port 9 that the number of connectors at nozzle assembly 18 if the apparatus does not have or require all of the on-apparatus sub-systems that nozzle assembly 18 is capable of supplying. In any case, nozzle assembly 18 is designed to mate in only one manner with the connectors at port 9.

FIGS. 1, 2 and 3 show embodiments with a fixed fluid maintenance facility 2 to which apparatus are taken for fluid maintenance. The system of the present invention, however, does not require that apparatus be brought to a fixed fluid maintenance facility.

Figure 4:
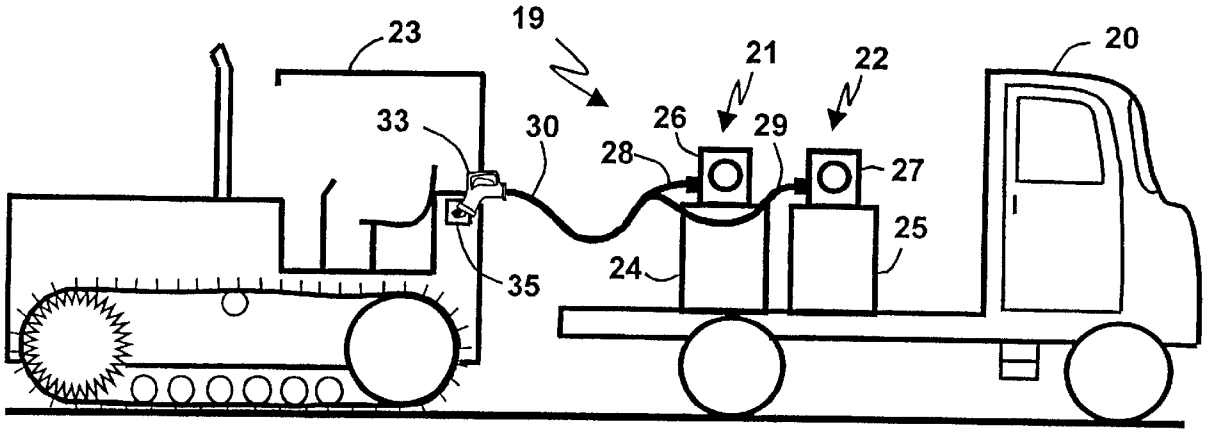
FIG. 4 is a schematic illustration of another invention embodiment in which the off-apparatus sub-systems and associated components are mobile (e.g., mounted on a truck) so they can be brought to the apparatus for fluid maintenance.

FIG. 4 shows an invention embodiment where fluid maintenance facility 19 is mounted on mobile vehicle 20 so that a multitude of off-apparatus sub-systems 21 and 22 (two of which are shown by way of example) can be transported to apparatus 23. Off-apparatus sub-systems 21, 22 include fluid reservoirs 24 and 25 with pumps 26 and 27 respectively for either storing and pumping maintenance fluids to apparatus 23 or pumping and receiving used fluids from apparatus 23. As in the embodiment of FIG. 3, the off-apparatus sub-systems 21, 22 have hoses 28 and 29 respectively with conduits (not shown) that merge into hose 30 with a multitude of conduits (not shown). Hose 30 terminates with nozzle assembly 33 that has a multitude of connectors (not shown) that connect to corresponding connectors (not shown) of on-apparatus sub-systems (not shown) at port 35 of apparatus 23.

In operation, periodically, when fluid maintenance is required or desired for apparatus 23, mobile fluid maintenance facility 19 is taken to apparatus 23, the connectors of nozzle assembly 33 are mated to the connectors at port 35 in a manner that assures the communication of the proper fluids and information between the on-apparatus sub-systems and the fluid reservoirs 24 and 25 of off-apparatus sub-systems 21, 22. One or more control means (not shown) determine the quantities of maintenance fluids required to maintain quality and/or level of the fluids to be maintained in apparatus 23, and control the pumps 26 and 27 to pump the determined quantities of the appropriate maintenance fluids to or used fluids from the on-apparatus sub-systems. At the completion of transferring all fluids, the control means can, if desired, record and/or provide a report of maintenance information. At the end of the maintenance process, nozzle assembly 33 is removed from port 35, and vehicle 20 with fluid maintenance facility 19 departs apparatus 23, and is then prepared to be taken to another apparatus with appropriate on-apparatus sub-systems for fluid maintenance.

Apparatus 23 can have a fewer number of connectors at port 35 than the number of connectors at nozzle assembly 33 since all apparatus serviced by mobile fluid maintenance facility 19 may not have the same fluid maintenance needs. To be mobile, fluid maintenance facility 19 need not be mounted on a self-powered vehicle 20. For example, fluid maintenance facility 19 can be mounted on a manually powered cart that is either pushed or pulled from one apparatus requiring fluid maintenance to the next.

Figure 5:
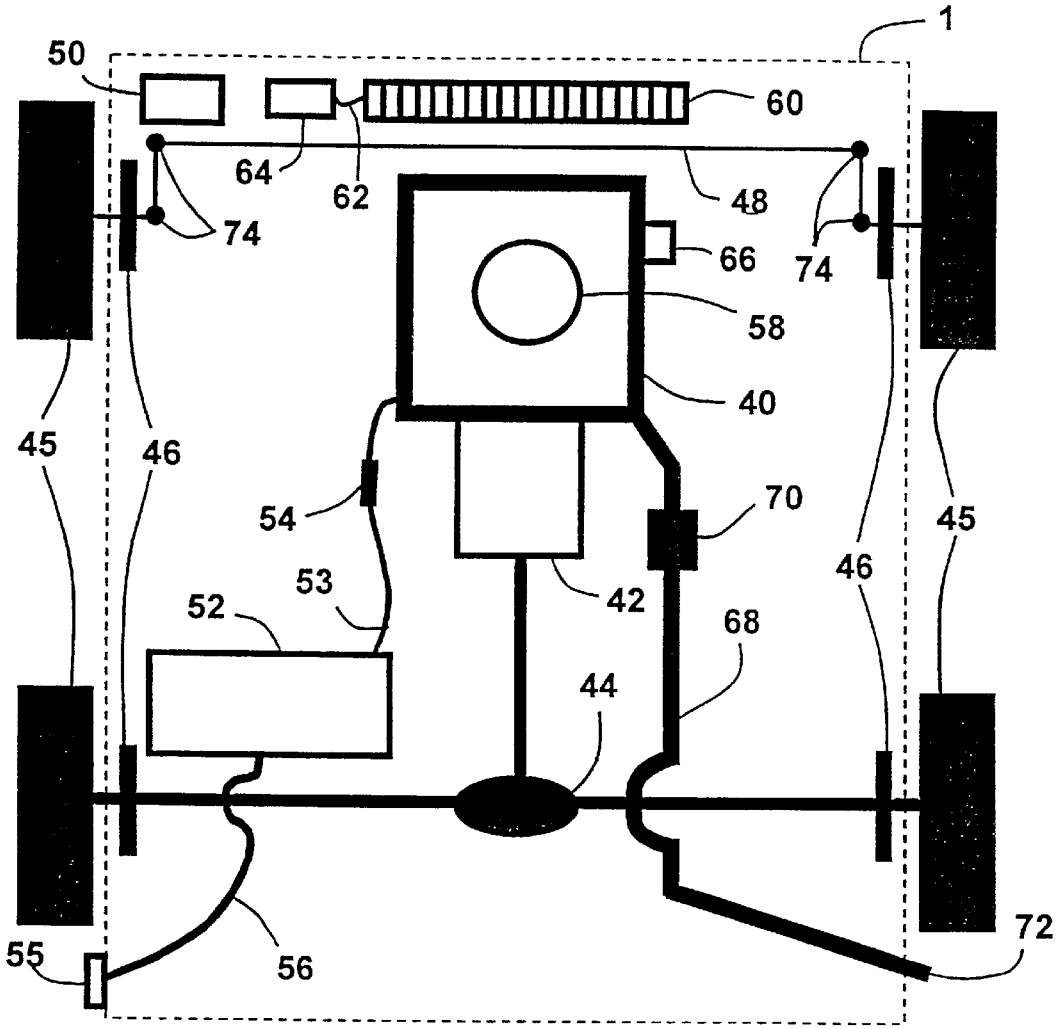
FIG. 5 is a schematic illustration of a transportation apparatus showing various fluids systems that can be maintained with embodiments of this invention.
Figure 6:
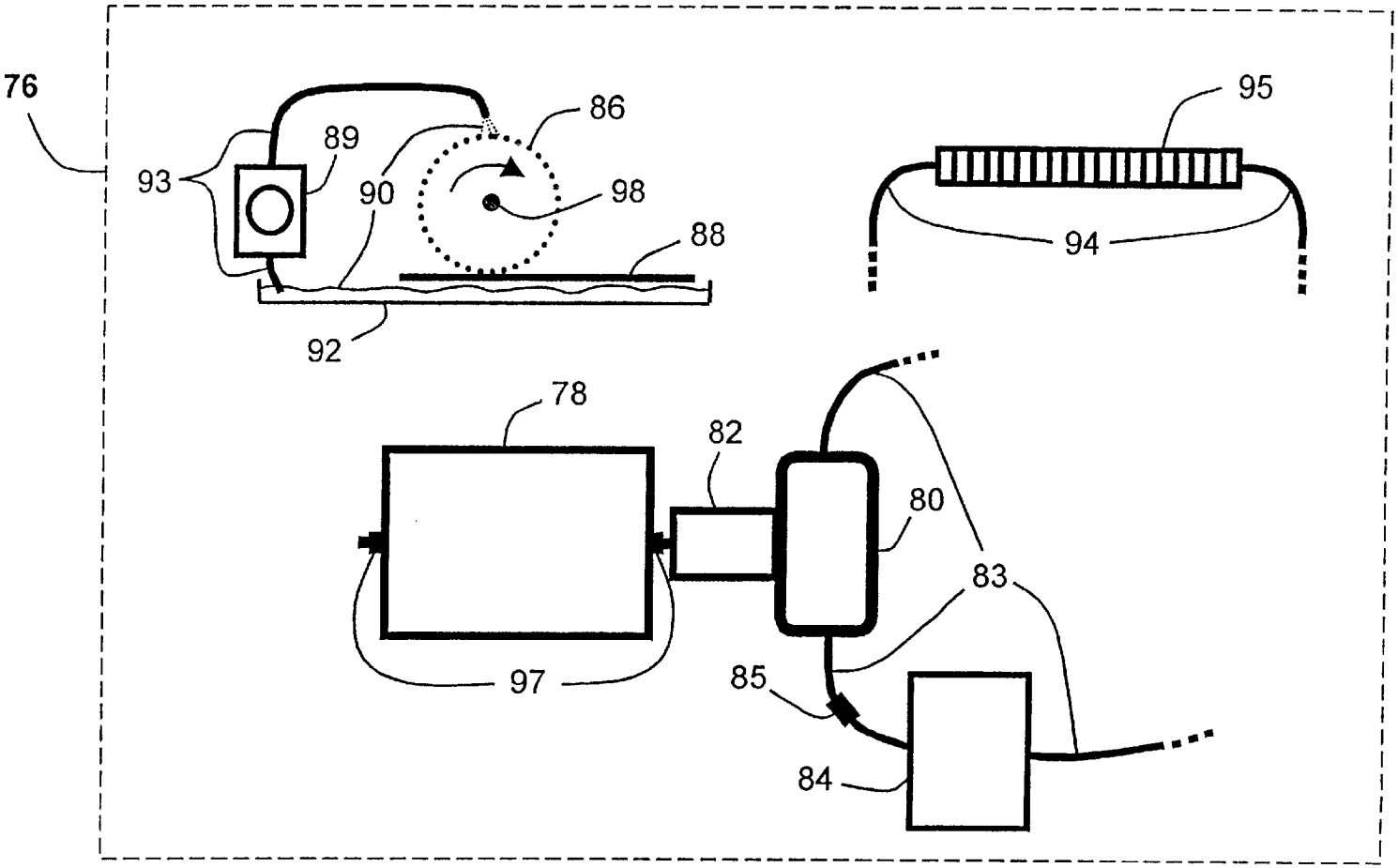
FIG. 6 is a schematic illustration of an industrial apparatus showing various fluid systems that can be maintained with embodiments of this invention.

For a better understanding of some of the apparatus components and sub-systems with fluids that might be maintained by the systems of the present invention, reference is made to FIGS. 5 and 6, which show exemplary apparatus.

FIG. 5 shows a schematic of transportation apparatus 1 powered by engine 40, transmission 42 and differential 44. Apparatus 1 includes brakes 46 with a hydraulic braking system (not shown) for slowing and stopping, steering assembly 48 with a hydraulic power steering pump (not shown) for directional control, and reservoir 50 that holds cleaning fluid for the apparatus' windshield (not shown). Engine 40 requires a fuel that is communicated from fuel tank 52 through fuel line 53, which contains fuelfilter 54. Fuel tank 52 is periodically replenished as needed with a nozzle from a fuel dispenser (not shown) that mates with port 55. Fuel is communicated from port 55 to fuel tank 52 through conduit 56.

Air enters engine 40 through air filter 58. Engine 40 is cooled during operation with a coolant that circulates through the engine and radiator 60. Radiator 60 communicates via conduit 62 with overflow reservoir 64 to allow for the thermal expansion and contraction of coolant during the intermittent operation of apparatus 1. An engine oil is used to lubricate engine 40 during operation. Filter 66 filters the oil during engine operation. Exhaust system 68 with emissions control device 70 carries the emissions from engine 40 to outlet 72 where the emissions are exhausted to the atmosphere. Steering assembly 48 and other chassis components (not shown) have bushings or joints 74 at various attachment points that require grease for proper performance and maximum service life. Although not shown, apparatus 1 may also include an air-conditioning system that includes a refrigerant for temperature control of the apparatus' passenger or cargo compartments.

Depending on type and service of apparatus 1, grease in bushings 74 and windshield cleaner fluid in reservoir 50 must be replenished to maintain safe operation of apparatus 1. The level of fluids contained in coolant overflow reservoir 64, engine 40, transmission 42 and differential 44 must be checked and maintained on a regular basis. Also conventional maintenance practices require periodic total replacement of such fluids in order to maintain proper performance over a long service life. Air pressure in tires 45 must be checked and engine oil filter 66, fuel filter 54 and air filter 58 must be cleaned or replaced on a scheduled basis. Engine exhaust from outlet 72 must be checked for proper performance and environmental regulatory compliance.

FIG. 6 shows a schematic of industrial apparatus 76 that includes electric motor 78 driving hydraulic pump 80 thorough transmission 82. Hydraulic pump 80 is part of a hydraulic circuit that includes hoses 83, hydraulic fluid reservoir 84 and hydraulic fluid filter 85. The hydraulic circuit also includes hydraulic devices, for example grinding wheel 86, that are powered by fluid pressure from the output of pump 80. During operation of apparatus 76, a suitable workpiece 88 is ground by wheel 86 while pump 89 pumps metalworking fluid 90 from metalworking fluid reservoir 92, through hose 93, onto grinding wheel 86 where it improves the quality and efficiency of the grinding process. The sprayed metalworking fluid 90 is then collected in metalworking fluid reservoir 92 for reuse in the grinding process.

To maintain the temperature of workpieces and apparatus 76 components and sub-systems during operation, coolant is pumped (pump not shown) through conduits 94 and radiator 95 to locations requiring temperature control. Bushings 97 and 98 on electric motor 78 and grinding wheel 86, respectively, and at other locations on apparatus 76 require grease for proper performance and maximum service life.

Depending on use and performance parameters of apparatus 76, periodically grease must be replenished in bushings 97 and 98, level of fluids contained in transmission 82, hydraulic reservoir 84 and metalworking reservoir 92 must be checked and maintained, transmission, hydraulic, metalworking fluids and coolants need replacement, and hydraulic fluid filter 85 must be replaced or cleaned to assure proper performance and/or long service life of apparatus 76.

Figure 7:
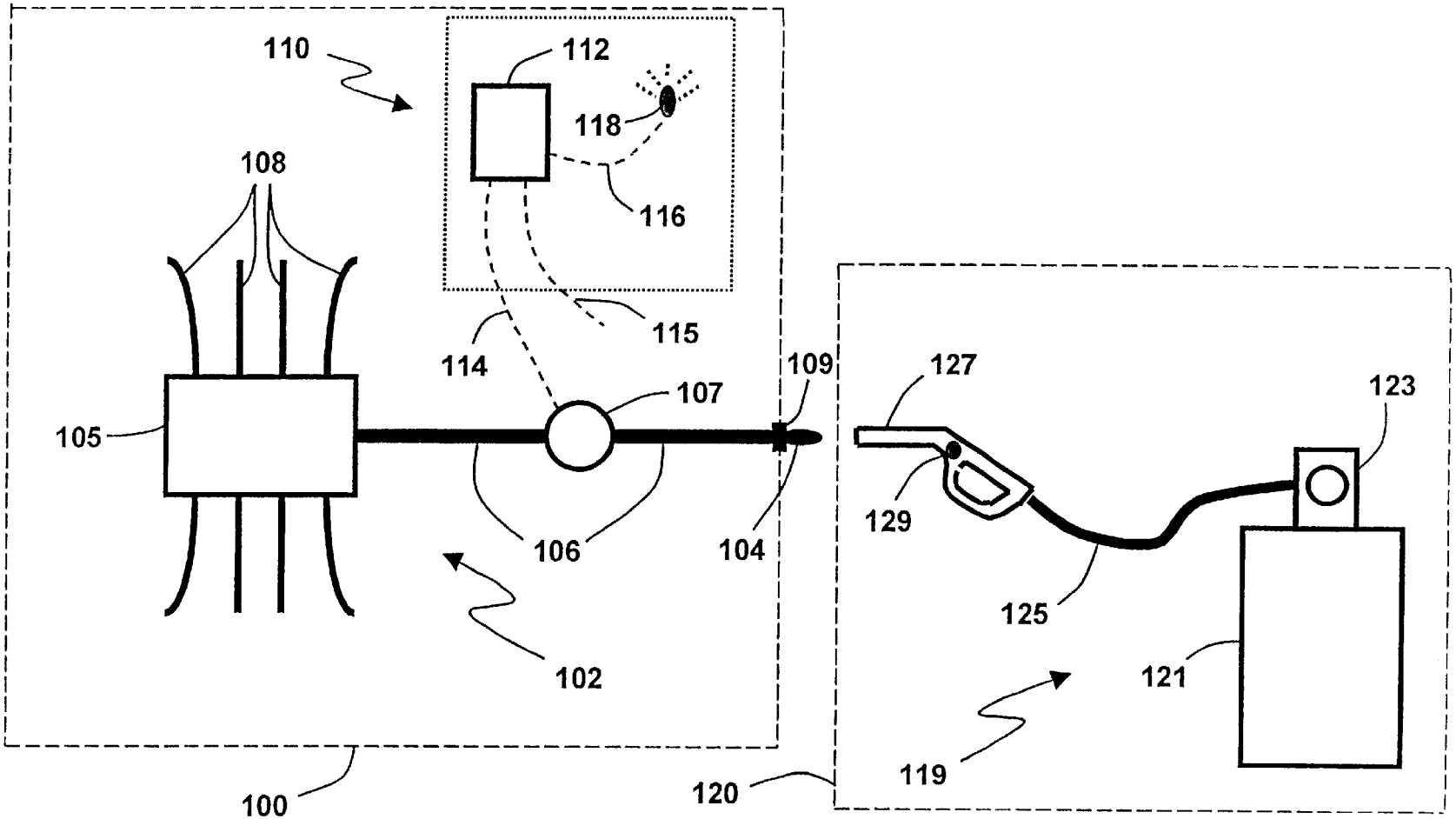
FIG. 7 is a schematic illustration of an invention embodiment for maintaining apparatus grease lubrication including an on-apparatus controller that signals a service technician for periodic servicing.

FIG. 7 shows an embodiment of a fluid maintenance system for replenishing grease on apparatus 100 which has components that require grease for proper performance or long service life. For example, apparatus 100 can be a transportation apparatus with chassis components like steering bushings 74 shown in FIG. 5, or can be industrial apparatus with bushings 97 and 98 shown in FIG. 6. The fluid maintenance system includes on-apparatus sub-system 102 that is mounted on apparatus 100. Sub-system 102 includes grease connector 104, distribution block 105, main conduit 106 with flow meter 107, and distribution conduits 108. Grease connector 104 is mounted at port 109 on apparatus 100. Grease connector 104 is normally closed preventing flow of grease through main conduit 106 unless mated with an appropriate connector. Distribution block 105 distributes grease from main conduit 106 in the proper volume ratios to distribution conduits 108 for communication to the appropriate components (not shown) of apparatus 100.

The fluid maintenance system also includes control means 110 mounted on apparatus 100. Controller 110 includes electronics module 112, input wires 114, 115, output wire 116 and signaling device 118. Input 115 communicates grease condition, component/apparatus use and/or condition information from sensors (not shown) to electronic module 112. The inputs to electronic module 112 can include one or more of the following: apparatus operating time since the last lubrication, distance traveled or operating cycles since the last lubrication, and friction of—or force required to move—individual greased components. Electronic module 112 uses input 114 to monitor the volume of lubrication applied to apparatus 100.

Input 114 is preferably from meter 107 that senses the amount of grease that passes through main conduit 106. Alternately, meter 107 may be placed in one or more of the distribution conduits 108. If distribution block 105 includes positive displacement elements of the type used in a progressive distributor, input 114 can be from a sensor mounted to distribution block 105 that monitors the cycling of a positive displacement piston. Input 114 can also be from sensor(s) at individual components that measure when sufficient grease is applied to the components.

Signaling device 118 may, for example, be a light that mounts on apparatus 100 in a convenient location for viewing by a maintenance provider and possibly by the operator. Signaling device 118 is electrically connected to electronic module 112 by output wire 116 and is turned "on" when electronic module 112 determines that the apparatus requires lubrication based on input 115, providing a continuous signal until the proper amount of grease is applied.

The fluid maintenance system further includes off-apparatus sub-system 119 that is mounted at fluid maintenance facility 120 where a multitude of apparatus, for example apparatus 100, that have on-apparatus sub-systems 102 and controller 110 can be serviced. Fluid maintenance facility 120 can be a fixed location if apparatus 100 can be moved to fluid maintenance facility 120, or can be mobile to enable the fluid maintenance facility 120 to be taken to apparatus 100. Off-apparatus sub-system 119 at fluid maintenance facility 120 includes grease reservoir 121, powered grease pump 123 (power source not shown), hose 125 and nozzle 127 with power switch 129 that is normally "off". Nozzle 127 is designed to mate in a leak-free manner with connector 104 on apparatus 100. Power switch 129 when turned "on" powers pump 123 to pump grease from grease reservoir 121 through hose 125 to nozzle 127.

In operation, electronic module 112 of controller 110 on apparatus 100 monitors grease quality, component/apparatus 100 use and/or condition information through input 115, and powers light or other signaling device 118 "on" through wire 116 when it determines that apparatus 100 requires grease based on the monitored parameters. When a service technician observes signaling device 118 "on", if apparatus 100 is in a fixed location, mobile fluid maintenance facility 120 is brought to apparatus 100, or if the fluid maintenance facility 120 is in a fixed location, then mobile apparatus 100 is taken to sub-system 119. The service technician mates nozzle 127 to connector 104 at port 109, and turns switch 129 "on" to pump grease from reservoir 121 into the on-apparatus grease distribution sub-system 102 and thereby to the components of apparatus 100 that require grease. Even as grease is being pumped into sub-system 102, electronic module 112 continues to monitor input 115 for grease condition, component/apparatus use and/or condition, so that the grease requirement for apparatus 100 is constantly being determined. When the sensed volume of grease through meter 107 equals or exceeds the determined grease need, electronic module 112 turns light or other signaling device 118 "off". The service technician observing signaling device 118 "off", turns "off" switch 129 to stop the flow of grease from pump 123, and nozzle 127 is removed from connector 104 at port 109. Apparatus 100 is then separated from fluid maintenance facility 120 so that off-apparatus subsystem 119 is ready to service another apparatus with sub-systems 102 and controller 110.

If properly equipped, when electronic module 112 no longer detects flow through meter 107, the module can record or report (with means not shown) grease maintenance information.

Since electronic module 112 is continuously monitoring grease requirement of apparatus 100, when the grease maintenance process is completed, electronic module 112 is already collecting information needed to determine when to turn signaling device 118 "on" for grease maintenance. In this manner, grease is maintained on apparatus 100 with the grease maintenance system that includes sub-systems 102, 119 and controller 110.

The grease maintenance system shown in FIG. 7 can also operate in another manner. If apparatus 100 and off-apparatus sub-system 119 are conveniently located together, for example while maintaining another fluid, and signaling device 118 is not "on", the service technician can "top-off" grease for apparatus 100 by mating nozzle 127 to connector 104 at port 109 and turning switch 129 to "on". Since electronic module 112 can determine at any time the volume of grease that needs replenished since the last application of grease, when electronic module 112 senses flow through meter 107, if electronic module 112 determines grease can be added to apparatus 100 without over greasing, signaling device 118 is turned "on" only until the grease is replenished. Hence, if the service technician observes signaling device 118 turned "on", grease can continue to be pumped. If light or other signaling device 118 is not turned "on", or when signaling device 118 is turned "off", the service technician turns switch 129 "off".

Although only a single signaling device 118 is shown in FIG. 7, controller 110 can have multiple signaling devices to alert when grease maintenance is required and when an appropriate amount of grease is applied. If apparatus 100 is in a fixed location, one of the signaling devices can be mounted in a location remote from the apparatus, for example in a central maintenance facility (not shown) where the signal will alert a service technician to take mobile fluid maintenance facility 120 with sub-system 119 to the particular apparatus that requires fluid maintenance. In the case of multiple signaling devices, only the signaling device seen or monitored by the service technician during the application of grease need remain continuously "on" until grease is applied. The other signaling devices need not be continuously "on"; for example they can be configured to be "on" only when the apparatus is on/operating.

The off-apparatus sub-system 119 shown in FIG. 7 has a powered grease pump 123 that is turned "on" by switch 129. The service provider, however, can manually power the grease pump, when maintaining grease for apparatus 100.

The on-apparatus sub-system 102 shown in FIG. 7 has only one distribution block 105; however, multiple sub-distribution blocks may be mounted in closer proximity to the components requiring grease for receiving grease from the main distribution block 105 and distributing the grease to the associated components.

Figure 8:
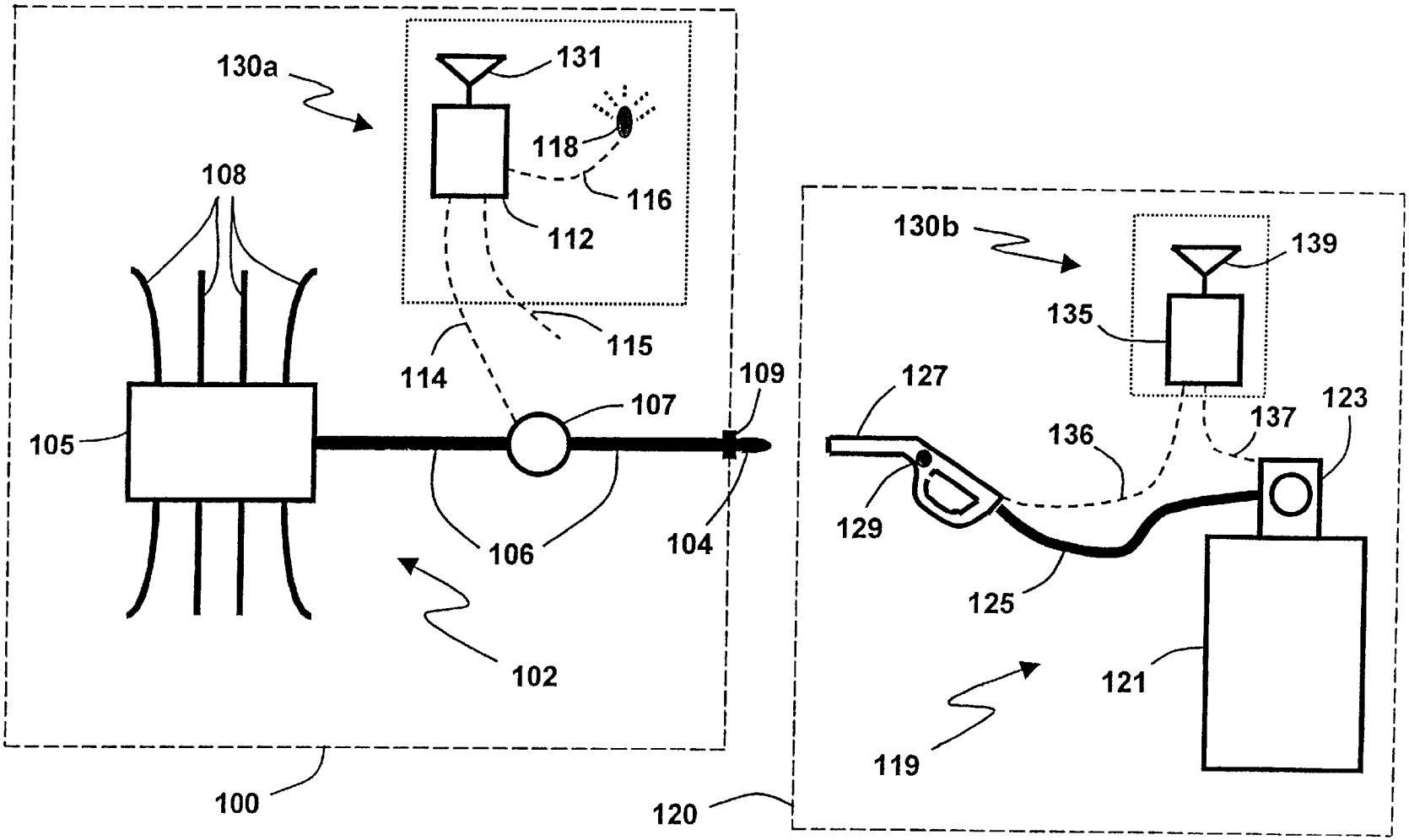
FIGS. 8–10 are schematic illustrations of other invention embodiments for periodically maintaining apparatus grease lubrication.

FIG. 8 shows another embodiment of a fluid maintenance system for replenishing grease on apparatus 100. This embodiment also includes on-apparatus grease maintenance sub-system 102 with grease connector 104 at port 109, distribution block 105, main conduit 106 with flow meter 107, and distribution conduits 108, and off-apparatus grease maintenance sub-system 119 at fluid maintenance facility 120 with grease reservoir 121, grease pump 123, hose 125 and nozzle 127 with switch 129. The control means in this embodiment has two controllers, controller 130*a* on apparatus 100 and controller 130*b* at fluid maintenance facility 120. Controller 130*a* includes electronic module 112 with input wire 114 communicating with meter 107, input wire 115 communicating grease condition, component/apparatus use and/or condition information, output wire 116 with signaling device 118, and radio frequency (RF) communication means 131. Controller 130*b* includes electronic module 135 with input 136 from switch 129 on nozzle 127, output 137 to provide power to grease pump 123, and RF communication means 139.

In operation electronic module 112 of controller 130*a* on apparatus 100 monitors input 115 and powers signaling device 118 "on" through wire 116 when it determines that apparatus 100 requires grease. A service technician, observing that signaling device 118 is "on", brings apparatus 100 and fluid maintenance facility 120 together, mates nozzle 127 to connector 104 at port 109, and turns switch 129 "on". Switch 129 powers electronic module 135 of off-apparatus controller 130*b* to communicate, using RF means 139 and 131, with electronic module 112 of on-apparatus controller 130*a*. Electronic module 112 transmits a signal that grease is needed, causing electronic module 135 to power pump 123 "on" through wire 137. When the sensed volume of grease through meter 107 equals the determined grease need, module 112 turns signaling device 118 "off" and transmits a signal that causes module 135 to turn pump 123 "off". When the service technician observes signaling device 118 is turned "off", the service technician turns switch 129 to "off" and removes nozzle 127 from connector 104 at port 109. Apparatus 100 and fluid maintenance facility 120 are separated so that fluid maintenance facility 120 is ready to service another apparatus with on-apparatus sub-system 102 and controller 130*a*. At the end of grease maintenance, electronic module 112 of apparatus 100 is already collecting information needed to determine when to turn signaling device 118 "on" for grease maintenance. In this manner, grease is maintained on apparatus 100 with the grease maintenance system that includes sub-systems 102, 119 and controllers 130*a*/130*b*.

If properly equipped, when electronic module 112 no longer detects flow through meter 107, the module can record or report (with means not shown) grease maintenance information.

This embodiment of the grease maintenance system can "top off" grease if apparatus 100 and off-apparatus sub-system 119 and controller 130*b* are conveniently located together. Any time nozzle 127 is mated to connector 104 at port 109 on apparatus 100, and switch 129 is turned to "on", electronic module 135 of controller 130*b* will communicate using RF means 139 and 131 with electronic module 112. If electronic module 112 determines that a volume of grease can be added to apparatus 100 without over greasing the apparatus, signaling device 118 is turned "on" and a signal transmitted to electronic module 135 that grease is needed causing grease to be pumped into sub-system 102. When electronic module 112 determines the grease is totally replenished, signaling device 118 is turned "off" and a signal transmitted to electronic module 135 to stop supplying grease. Nozzle 127 is then removed from connector 104 at port 109.

In FIG. 8, wire 136 between electronic module 135 and switch 129 on nozzle 127, and hose 125, which provides a grease conduit between pump 123 and nozzle 127, are illustrated with separate connections to nozzle 127. Hose 125, however, could be constructed to incorporate wire 136 into the hose if desired.

In the embodiments shown in FIGS. 7 and 8, the control means uses only on-apparatus information and algorithms stored in the controller electronic modules, in particular electronic module 112, to determine the quantity of grease to apply. Also these two embodiments monitor the quantity of grease applied to the apparatus with sensor(s) mounted on the apparatus.

Figure 9:
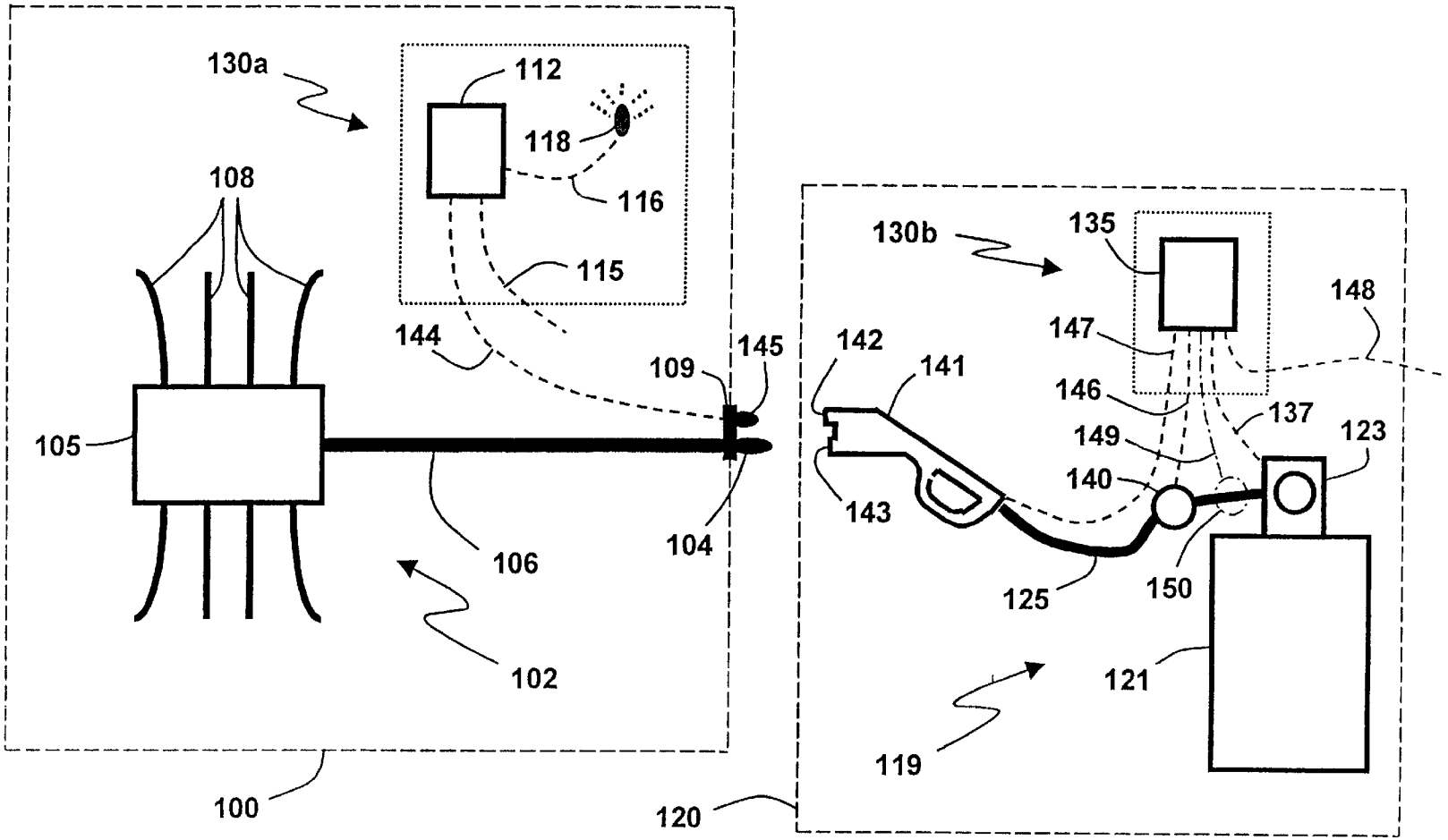

FIG. 9 shows an invention embodiment that allows remote grease maintenance information to be used in controlling the grease maintenance for a particular apparatus, and uses a meter in the off-apparatus sub-system to monitor the amount of grease applied to apparatus. This embodiment includes on-apparatus sub-system 102 with grease connector 104 at port 109, distribution block 105, main conduit 106, and distribution conduits 108, and off-apparatus grease lubrication sub-system 119 at fluid maintenance facility 120 with grease reservoir 121, grease pump 123, hose 125 with meter 140 and nozzle assembly 141 with connectors 142 and 143. The control means of this embodiment has two controllers, on-apparatus controller 130*a* and off-apparatus controller 130*b*. Controller 130*a* includes electronic module 112 with input wire 115 communicating grease condition, apparatus 100 use and/or condition information (information source(s) not shown), output wire 116 with signaling device 118 and communication wire 144 with connector 145 at port 109. Controller 130*b* includes electronic module 135, output wire 137 to pump 123, input wire 146 from meter 140, communication wire 147 that terminates at connector 142 on nozzle assembly 141, and communication wire 148.

Connectors 143 and 142 of nozzle assembly 141 are designed to mate with connectors 104 and 145 respectively at port 109 in a manner that allows grease to be communicated from hose 125 to main conduit 106 and that allows information to be communicated between wires or conduits 144 and 147. Conduits 144, 147 can be designed to communicate optical, electrical or acoustic information between on-apparatus electronic module 112 of controller 130*a* and off-apparatus electronic module 135 of controller 130*b*.

Communication wire or conduit 148 allows electronic module 135 to communicate with a location remote from fluid maintenance facility 120 to obtain information about a particular apparatus that is useful in maintaining the grease of that apparatus. If fluid maintenance facility 120 is fixed, conduit 148 can be a continuous communication conduit, for example a wire to the remote location, or if fluid maintenance facility 120 is mobile, conduit 148 can be a RF communication means (not shown) for communicating with a remote location.

In operation, electronic module 112 of controller 130*a* monitors grease condition, component/apparatus use and/or condition information through input 115, and powers signaling device 118 "on" through wire 116 when it determines that apparatus 100 requires grease. When a service technician observes signaling device 118 "on", apparatus 100 and fluid maintenance facility 120 are brought together and the maintenance provider mates connectors 143 and 142 of nozzle assembly 141 to connectors 104 and 145 respectively at port 109. Using communication conduits 144, 147, electronic module 112 of controller 130*a* communicates the identity of and other relevant information about apparatus 100 and the volume of grease required by apparatus 100, to electronic module 135 of controller 130*b*. Using communication conduit 148, electronic module 135 communicates the apparatus 100 identity and relevant information to a remote location that contains maintenance information about apparatus 100 to determine if there is further information needed to maintain the grease of apparatus 100. For examples, electronic module 135 could receive information about a change in grease maintenance for apparatus 100 that requires a proportionate change in the volume of grease to apply to apparatus 100; or, if electronic module 135 has an input wire 149 from pressure sensor 150 (shown in phantom line in FIG. 9) to monitor grease pressure during pumping, the module could receive information about expected pressures for apparatus 100, so that if pressures greater or less that the expected values are monitored, the electronic module 135 can diagnose system or component maintenance may be required. In any case, unless electronic module 135 receives information from the remote location not to pump grease, electronic module 135 powers pump 123 "on", causing grease to flow from grease reservoir 121, through on-apparatus sub-system 102 to the apparatus components that require grease. Electronic module 135 monitors meter 140 for the volume of grease pumped through hose 125, and when the volume equals the volume determined by electronic module 112, or a corrected volume determined by electronic module 135 using received information from the remote location, pump 123 is turned "off"stopping the flow of grease. If controller 130*b* determines there are no problems with either grease lubricated apparatus components or with the grease maintenance system based on the received information from the remote location, electronic module 135 communicates with electronic module 112 to turn signaling device 118 "off". If controller 130*b* determines that there may be a problem with grease lubricated apparatus components or grease maintenance system components, electronic module 135 communicates with electronic module 112 to alert a maintenance technician that there may be a problem, for example, by applying intermittent power to signaling device 118 so that the signaling device provides an intermittent or "flashing" signal.

Using communication conduits 144, 147, electronic module 135 of off-apparatus controller 130*b* can report maintenance information for storage in electronic module 112 of on-apparatus controller 130*a*. Using communication conduit 148, electronic module 135 can communicate reports to remote locations. Reports communicated to one or more remote locations can be used for a variety of purposes. For example, a report can be communicated that schedules maintenance for apparatus 100 if controller 130*b* has diagnosed a possible problem with a lubricated component or the grease maintenance sub-system of apparatus 100.

Whenever the service technician observes that the light or other signaling device 118 is turned "off" or is "flashing", nozzle assembly 141 is removed from connectors 104 and 145 at port 109, which, if signaling device 118 is "flashing", causes the signaling device to be turned "off". Apparatus 100 and fluid maintenance facility 120 are then separated, leaving fluid maintenance facility 120 with off-apparatus sub-system 119 ready to service another apparatus with sub-system 102 and controller 130*a*.

It should be noted, that although not shown in FIG. 9, controller 130*b* can include visual displays or a printer for reporting to the maintenance technician or apparatus operator the volume of grease used, the cost of the grease maintenance, and/or any potential problems with apparatus 100.

Figure 10:
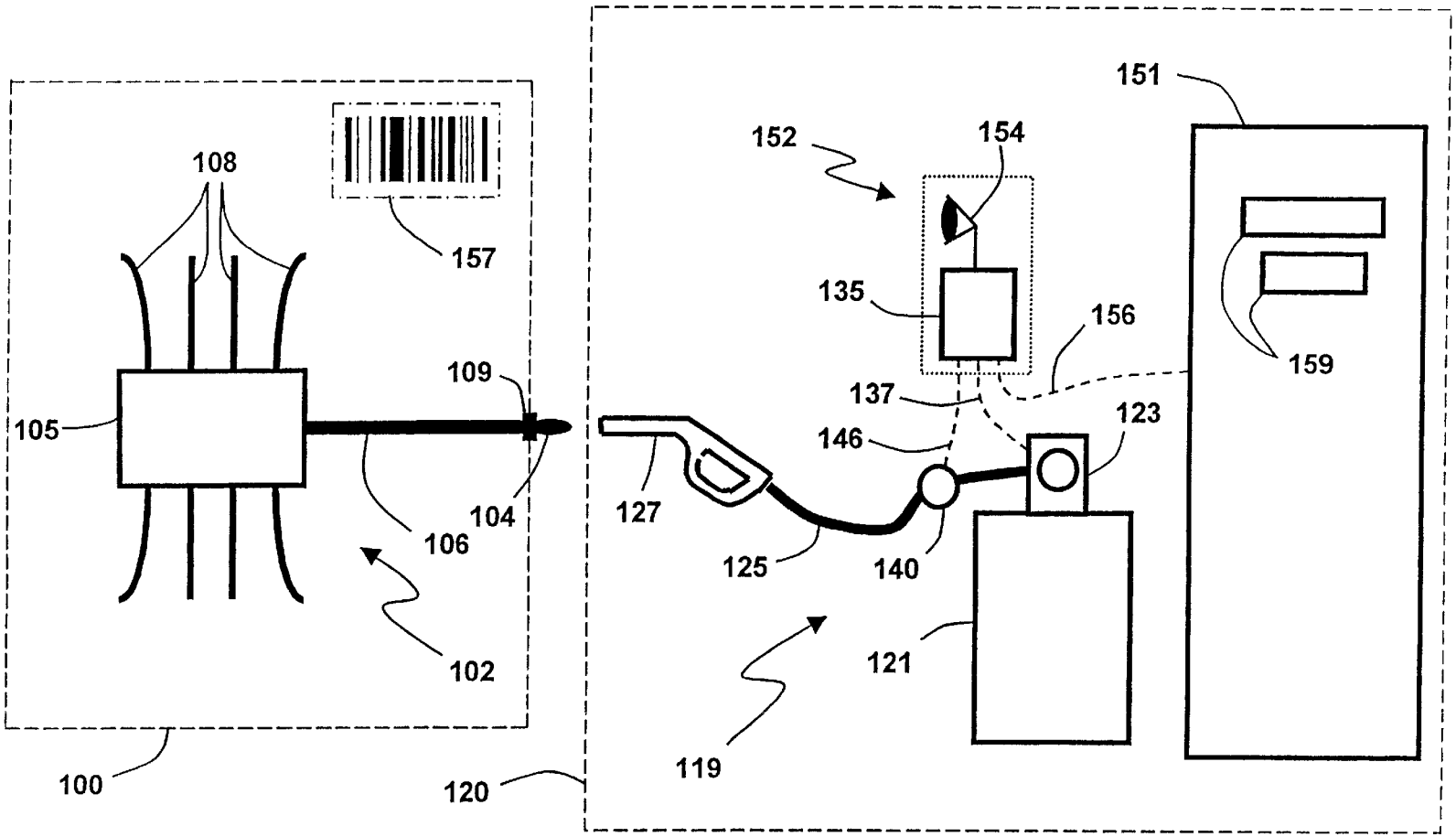

FIG. 10 shows an embodiment of the invention where fluid maintenance facility 120, either fixed or mobile, includes refueling system 151, which is used to refuel apparatus 100, and that is used in conjunction with the off-apparatus sub-system and controller for maintaining the grease of apparatus 100. Referring to FIG. 10, sub-system 102 on apparatus 100 includes grease connector 104 at port 109, distribution block 105, main conduit 106, and distribution conduits 108. Off-apparatus sub-system at fluid maintenance facility 120 includes grease reservoir 121, pump 123, hose 125 with meter 140, and nozzle 127. The controller 152 located at fluid maintenance facility 120 is the only controller of this embodiment. Controller 152 includes electronic module 135, output wire 137 to pump 123, input wire 146 from meter 140, optical scanner 154, and communication wire 156 to fueling system 151. Optical scanner 154 is designed to read optical code 157 on apparatus 100.

In this embodiment, the apparatus use information monitored by controller 152 to determine grease volume needed to maintain grease quality in apparatus 100 is based on the amount of fuel added to apparatus 100 during refueling. That is, grease quantity is maintained by adding a volume of grease that is a ratio of the fuel added during refueling. Optical code 157 of apparatus 100 either can directly include information about the grease-to-fuel ratio to be used by electronic module 135 of controller 152, or can include apparatus identification information that allows electronic module 135 to obtain the grease-to-fuel ratio from data that is either stored in electronic module 135 or is stored at locations that can communicate with module 135 using communication wire or conduit 156 or other communication means (not shown).

In operation, when apparatus 100 and fluid maintenance facility 120 are brought together for periodic refueling of apparatus 100, controller 152, using optical scanner 154, reads optical code 157 and determines the grease-to-fuel ratio for apparatus 100. A service technician or the operator of apparatus 100 mates a conduit (not shown) from fueling system 151 to a port on apparatus 100 (not shown) for refueling, and mates nozzle 127 to connector 104 at port 109. When refueling begins, electronic module 135, using communication conduit 156, monitors the amount of fuel being transferred by fueling system 151 to apparatus 100. Using the determined grease-to-fuel ratio, electronic module 135 regulates the power applied to pump 123 to pump the desired grease volume through hose 125 as monitored by meter 140.

In this embodiment, as electronic module 135 monitors the volume of grease pumped, that information is communicated to refueling system 151 so that the volume and cost of grease can be included in the information displayed on visual outputs 159 of refueling system 151. At the end of refueling, nozzle 127 is removed from connector 104 and the refueling conduit (not shown) is removed from apparatus 100. If optical code 157 includes the identity of apparatus 100, a record of grease maintenance information can be stored in controller 152 for later downloading through a communication port (not shown), or can be communication to remote location(s) using communication wire or conduit 156 or another communication conduit (not shown). In this manner, grease quality is maintained each time that apparatus 100 is refueled.

The embodiment shown in FIG. 10 has optical code 157 on apparatus 100 and optical scanner 154 at fluid maintenance facility 120 to communicate grease-to-fuel ratio and/or identify apparatus 100. Other known means of device identification can similarly be used. As examples, controller 152 could include a key pad (not shown) that allows a service technician or the operator of apparatus 100 to enter an identification or grease-to-fuel ratio information, a card reader (not shown) where a card could be inserted to input information, or an RF receiver to monitor a passive radio frequency identification (RFID) tag. Alternatively controller 152 could receive information from fueling system 151 using communication conduit 156 to receive identification about apparatus 100 that is determined by fueling system 151.

The embodiment shown in FIG. 10 has separate pump 123 and meter 140. Pump 123 can be a metering pump that does not require electronic module 135 of controller 152 to receive feedback from meter 140 to control the volume of grease being pumped from grease reservoir 121 to apparatus 100.

The embodiment shown in FIG. 10 has hose 125, nozzle 127 and port 109 for grease maintenance separate from the described conduit, nozzle and port used for refueling apparatus 100. Hose 125, nozzle 127, however, can be integrated with the refueling conduit and nozzle at fluid maintenance facility 120 and port 109 can be integrated with the refueling port of apparatus 100 such that only one hose with multiple conduits and a nozzle assembly with multiple connectors can mate with multiple connectors at one port on apparatus 100 in a manner that both grease maintenance and refueling can occur with only one connection between apparatus 100 and fluid maintenance facility 120.

FIGS. 6–10 show invention embodiments where a fluid is maintained by replenishing with a maintenance fluid. Some fluids, however, require fluid replacement to maintain quality. Oil used to lubricate an internal combustion engine is an example of a fluid that may require replacement to maintain quality.

Figure 11:
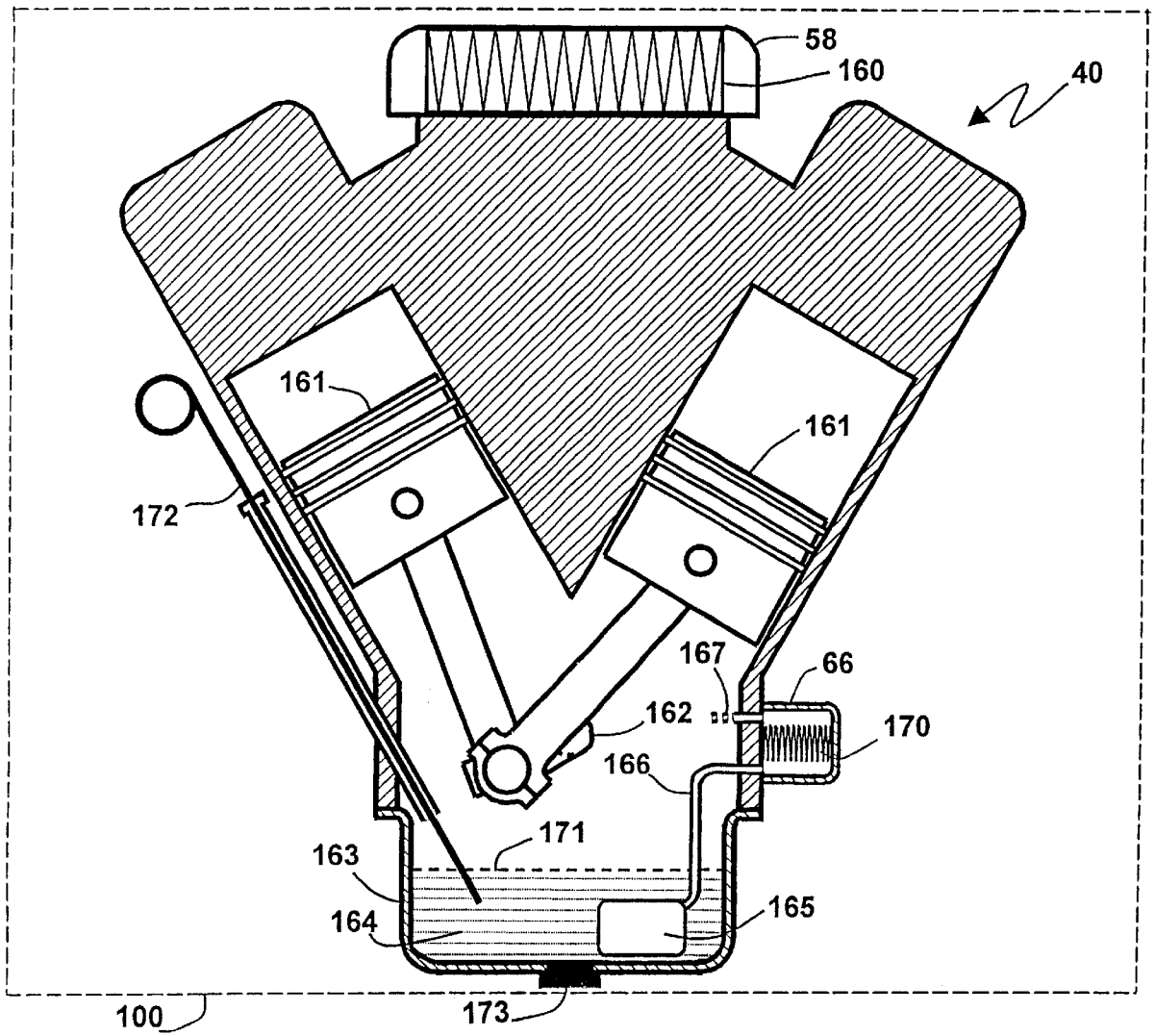
FIG. 11 is a schematic section of an internal combustion engine.

FIG. 11 is a sectional drawing of the internal combustion engine 40 in apparatus 100. Engine 40 has air filter 58 with filter element 160, which removes undesired debris from ambient air to provide clean air for fuel combustion. Pistons 161 and drive crankshaft 162 and other engine components (not shown) require a fluid lubricant to reduce friction and wear during normal operation. Engine 40 includes oil reservoir 163 containing engine oil 164 and fluid pump 165.

During engine operation, pump 165 pumps oil 164 from oil reservoir 163, through conduit 166, replaceable oil filter 66 and conduit 167, ultimately applying oil 164 to lubricate the moving components including pistons 161 and crankshaft 162. Oil filter 66 has filter element 170, which removes undesired debris as the oil 164 passes through the filter. Oil reservoir 163 is shown filled with oil 164 to the engine manufacturer's recommended level 171. Dipstick 172 is used to determine the level of oil 164 in oil reservoir 163. Drain plug 173 threads into oil reservoir 163 allowing oil 164 to be removed from engine 40. Near the top of the engine 40 is a port (not shown) that allows oil 164 to be added to the engine.

Using conventional maintenance practices, during use of apparatus 100, the level of oil 164 is periodically checked using dipstick 172, and, if the oil is not at recommended level 171, a volume of oil is added to reservoir 163 to achieve the recommended oil level. At intervals determined either by the engine manufacturer or the service practices of the apparatus owner, used oil 164 is removed from engine 40 using drain plug 173, and fresh oil is added to the engine to maintain the quality of the oil 164 in reservoir 163. During these oil changes, oil filter 66 is replaced with a clean filter. Also air filter element 160 may be checked to determine if replacement is needed.

Figure 12:
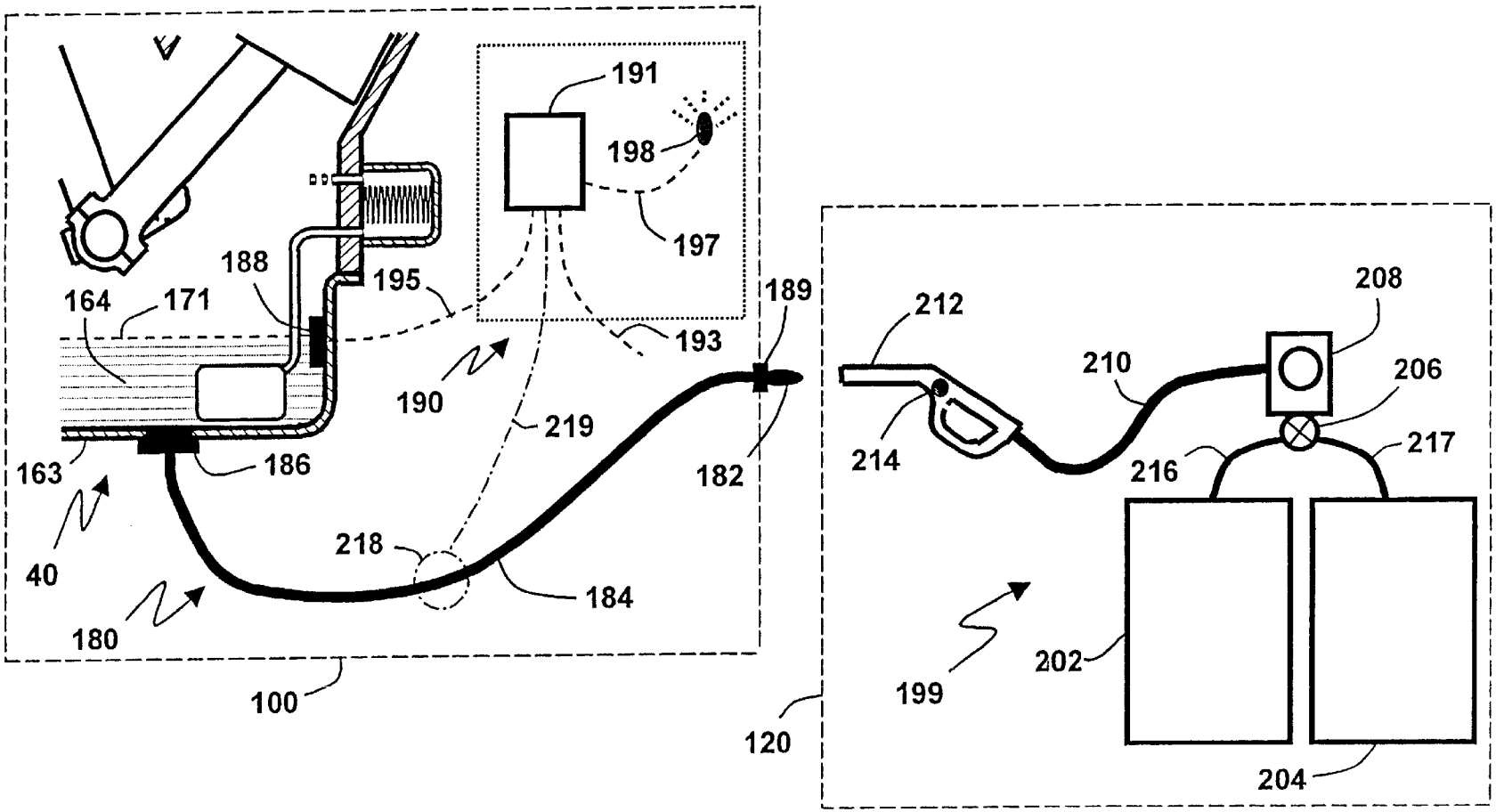
FIG. 12 is a schematic illustration of another invention embodiment for periodically maintaining the quality and level of engine oil.

FIG. 12 shows an embodiment of a fluid maintenance system for periodically maintaining the level and quality of the engine oil 164 in internal combustion engine 40 of apparatus 100, at an off-apparatus fluid maintenance facility 120. The fluid maintenance system includes on-apparatus sub-system 180 with oil connector 182, conduit 184, oil reservoir fitting 186, and oil level sensor 188. Oil connector 182 is mounted at port 189 on apparatus 100. and is designed and constructed such that fluid can flow through connector 182 only when connected to an appropriate mating connector. Oil reservoir fitting 186 allows conduit 184 to communicate with oil reservoir 163. Oil level sensor 188 senses the level of oil 164 in oil reservoir 163.

The fluid maintenance system also includes controller 190 mounted on apparatus 100 that includes electronic module 191, with input wires 193 and 195, output wire 197 and signaling device 198. Input 193 communicates oil condition, engine/apparatus use and/or condition information from sensors (not shown) to electronic module 191. Input 195 communicates information from level sensor 188 to electronic module 191 to determine if the level of oil 164 in oil reservoir 163 is at the manufacturer's recommended level 171.

The fluid maintenance system further includes off-apparatus sub-system 199 mounted at fluid maintenance facility 120. The off-apparatus sub-system 199 includes used oil reservoir 202, maintenance oil reservoir 204, valve 206, pump 208, hose 210, nozzle 212 with switch 214, and conduits 216 and 217. The maintenance oil contained in reservoir 204 can be fresh oil of the same type as oil 164 contained in engine oil reservoir 163 of engine 40, or can be a specially formulated fluid that renews the performance properties of oil 164. Nozzle 212 mates in a leak-free manner with connector 182 of on-apparatus sub-system 180, and is designed such that, only when mated to an appropriate connector, fluid can flow through nozzle 212. Switch 214 is a three-position switch. In one position, switch 214 activates valve 206 to allow communication between conduit 216 and pump 208 and to prevent communication through conduit 217, and powers pump 208 to pump fluid from nozzle 212 to used oil reservoir 202. In a second position, switch 214 activates valve 206 to allow communication between conduit 217 and pump 208 and to prevent communication through conduit 216, and powers pump 208 to pump fluid from maintenance oil reservoir 204 to nozzle 212. In a third position, switch 214 activates valve 206 to prevent communication through conduits 216, 217, and provides no power to pump 208.

In operation, electronic module 191 of controller 190 monitors oil condition, engine/apparatus use and/or condition information through input 193, and level sensor 188 through input 195. When electronic module 191 determines that the quality of engine oil 164 has deteriorated below a predetermined quality level, signaling device 198 is powered to be continuously "on". When a service technician or apparatus operator observes signaling device 198 "on", apparatus 100 and fluid maintenance facility 120 are brought together and nozzle 212 is mated to connector 182 at port 189 allowing hose 210 to communicate with conduit 184. The maintenance technician then turns switch 214 to the first position causing used oil 164 to be pumped from engine oil reservoir 163 of apparatus 100 into used oil reservoir 202 at fluid maintenance facility 120. Monitoring level sensor 188, when the determined volume of used oil 164 is removed from oil reservoir 163, electronic module 191 begins to apply intermittent power to signaling device 198 so that the signaling device provides an intermittent signal (for example, a flashing light). Observing the intermittent signal, a service technician turns switch 214 to the second position causing maintenance oil to be pumped from maintenance oil reservoir 204 at service location 120 to engine oil reservoir 163 of apparatus 100. When electronic module 191, monitoring oil level sensor 188, determines that the level of oil 164 in oil reservoir 163 is at the manufacturer's recommended level 171, controller 191 turns signaling device 198 "off". Observing signaling device 198 turned "off", a service technician turns switch 214 to the third position, which turns pump 208 "off" and stops the flow of oil either to or from oil reservoir 163. If electronic module 191 determines that, due to the inattentiveness of the maintenance technician, extra maintenance oil was pumped into oil reservoir 163 after signaling device 198 was turned "off", electronic module turns signaling device continuously "on" once again to alert the service technician that a volume of oil must be removed to achieve the proper oil level 171 in engine 40. Electronic module 191 permanently turns signaling device 198 "off" only when the exchange of used and maintenance oil is appropriate to maintain oil quality and level. When signaling device 198 is permanently "off", nozzle 212 is removed from connector 182, and apparatus 100 and fluid maintenance facility 120 separate. In this manner, the engine oil quality of apparatus 100 is maintained and fluid maintenance facility 120 with off-apparatus subsystem 199 is ready to maintain the engine oil of the next apparatus with subsystems 180, 190 that requires oil maintenance.

Such engine oil maintenance applies not only when electronic module 191 of controller 190 determines that the quality of oil 164 is below a predetermined quality limit, but also when oil level is below a predetermined level limit. When oil level is a predetermined volume below the manufacturer's recommended level 171, electronic module 191 turns signaling device 198 "on" even if oil quality is above the quality limit. Since electronic module 191 is constantly monitoring input 193, the volume of use oil that needs to be removed and replaced with maintenance fluid is constantly being determined. Hence, when a service technician or the apparatus operator observes signaling device 198 "on", apparatus 100 and fluid maintenance facility 120 are brought together, nozzle 212 is mated to connector 182 and switch 214 is turned to the first position to pump used oil from engine oil reservoir 164 to used oil reservoir 202. The electronic module 191 will intermittently operate signaling device 198 when the appropriate amount of used oil is removed. When the service technician observes the intermittent operation of signaling device 198, switch 214 is switched to the second position to pump maintenance oil from reservoir 204 to engine oil reservoir 164. Electronic module 191 only permanently turns signaling device 198 "off" when oil 164 is at the manufacturer's recommended level 171, at which time the service technician removes nozzle 212 from connector 182, and apparatus 100 and service location 120 separate. In this manner, both the quality and the level of engine oil 164 in engine 40 of apparatus 100 is maintained.

If apparatus 100 and fluid maintenance facility 120 are conveniently located together, for example while maintaining another fluid, and signaling device 198 is not "on", the service technician can "top-off" the oil quality and level of oil in engine reservoir 163 by mating nozzle 212 to connector 182 at port 189 and turning switch 214 to the first position to pump used oil 164 from engine oil reservoir 163 to used oil reservoir 202 at fluid maintenance facility 120.

Monitoring level sensor 188, electronic module 191 of controller 190 recognizes that an oil maintenance process has begun. Since electronic module 191 is constantly monitoring input 193, the volume of use oil that needs to be removed and replaced with maintenance fluid is constantly being determined. Hence, if electronic module 190 determines that used oil 164 should be removed, the module turns signaling device 198 "on". Once the determined amount of used oil is removed, or if electronic module 190 determines that no used oil needs to be removed, electronic module 191 causes intermittent operation of signaling device 198. When the service technician observes the intermittent operation of signaling device 198, switch 214 is turned to the second position to pump maintenance oil from reservoir 204 to engine oil reservoir 164. Electronic module 191 only permanently turns signaling device 198 "off" when oil 164 is at the manufacturer's recommended level 171, at which time the service technician removes nozzle 212 from connector 182, and apparatus 100 and fluid maintenance facility 120 separate as before. In this manner, both the quality and the level of engine oil 164 in engine 40 of apparatus 100 is maintained.

In any case of oil maintenance, when electronic module 191 of controller 190 turns signaling device 198 "off" at the end of oil maintenance, the module can record or report engine oil maintenance information.

If engine 40 does not consume or lose engine oil during operation, or if engine oil loss or consumption is predictable from the oil condition, engine/apparatus use and/or condition information monitored by electronic module input 193, the level sensor 188 and input wire 195 can be replaced with a meter 218 and input wire 219 (shown in phantom lines in FIG. 12). In operation, when electronic module 191, from oil quality, engine/apparatus use and/or performance input 193, determines that the quality or level of engine oil 164 has deteriorated below predetermined limits, electronic module 191 turns signaling device 198 "on" and controls the removal of a determined volume of used oil 164 from and the addition of a determined volume of maintenance oil to oil reservoir 163 by monitoring the inline meter 218.

Figure 13:
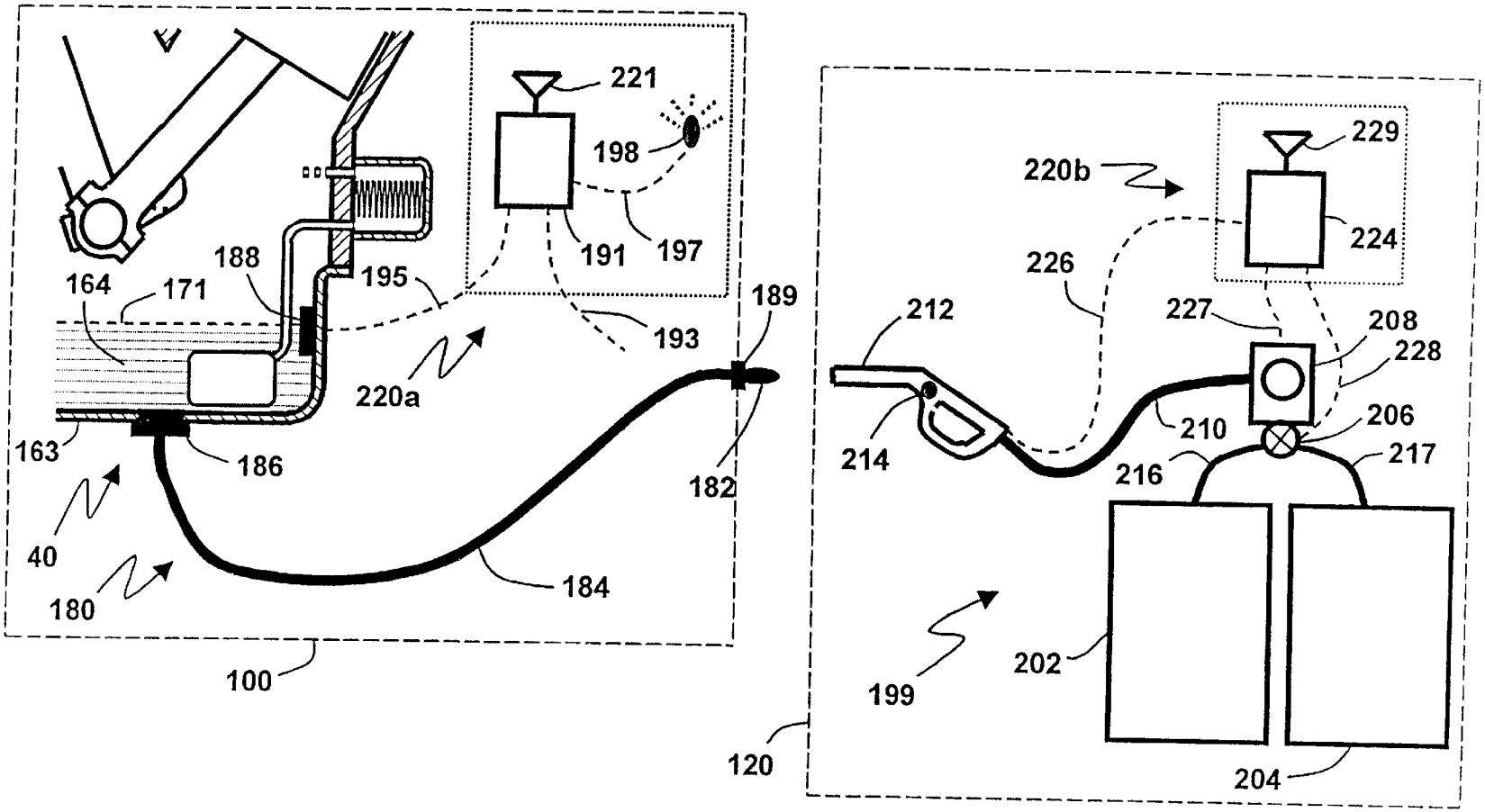
FIGS. 13–15 are schematic illustrations of other invention embodiments for periodically maintaining the quality and level of engine oil.

FIG. 13 shows another embodiment of a fluid maintenance system for maintaining the quality and level of engine oil 164 in engine 40 of apparatus 100. This embodiment includes on-apparatus sub-system 180 which includes oil connector 182, conduit 184, oil reservoir fitting 186 and oil level sensor 188, and off-apparatus sub-system 199 mounted at fluid maintenance facility 120 comprising used oil reservoir 202, maintenance oil reservoir 204, valve 206, pump 208, hose 210, and nozzle 212 with on/off switch 214. The control means in this embodiment has two controllers, controller 220*a* mounted on apparatus 100 and controller 220*b* mounted at fluid maintenance facility 120. Controller 220*a* includes electronic module 191 with input wire 195 from level sensor 188, input wire 193 from oil quality, engine/apparatus use and/or condition sensors (not shown), output wire 197 to signaling device 198, and RF communication means 221. Controller 220*b* includes electronic module 224, with input 226 from switch 214 on nozzle 212, output 227 to pump 208, output 228 to valve 206 and RF communication means 229.

In operation, this embodiment is similar to the embodiment shown in FIG. 12. If electronic module 191 determines that the quality or level of oil 164 has deteriorated below predetermined limits, signaling device 198 is powered continuously "on". When a service technician or the vehicle operator observes signaling device 198 "on", apparatus 100 and service location 120 are brought together, nozzle 212 is mated to connector 182 at port 189, and switch 214 is turned "on" causing electronic module 224 to communicate, using RF means 229 and 221, with electronic module 191.

Electronic module 191 transmits a signal to electronic module 224 that used oil must be removed from engine oil reservoir 163 which causes electronic module 224 to power pump 208 and valve 206 in a manner to pump used oil from oil reservoir 163 to used oil reservoir 202 at fuel maintenance facility 120. When the volume of use oil 164 determined by electronic module 191 and measured by oil level sensor 188 is removed, the module begins intermittently powering signaling device 198 and transmits a signal to electronic module 224 to power pump 208 and valve 206 in a manner to pump oil from maintenance oil reservoir 204 to engine oil reservoir 163. When oil 164 is at the manufacturer's recommended level 171, electronic module 191 turns signaling device 198 "off" and transmits a signal to electronic module 224 to turn pump 208 "off" and cause valve 206 to block flow of fluid into or out of reservoirs 202 and 204.

This embodiment can also be used to "top-off" oil quality and level when apparatus 100 and fluid maintenance facility 120 are conveniently located together and signaling device 198 is not "on". Any time a service technician mates nozzle 212 to connector 182 at port 189 and turns switch 214 "on", electronic module 224 communicates, using RF means 229 and 221, with electronic module 191. If electronic module 191 determines a volume of used oil needs to be removed from or a volume of maintenance oil needs to be added to engine oil reservoir 163, the module will send the appropriate signals and power signaling device 198 in the appropriate manner, to control the maintenance process and alert the maintenance technician respectively. If signaling device 198 is not turned "on" because oil maintenance is not needed, or when signaling device 198 is turned "off" at the end of the maintenance operation, the service technician removes nozzle 212 from connector 182, and apparatus 100 and fluid maintenance facility 120 are separated.

Each time electronic module 191 of controller 190 turns signaling device 198 "off" at the end of oil maintenance, the module can record or report oil maintenance information.

Figure 14:
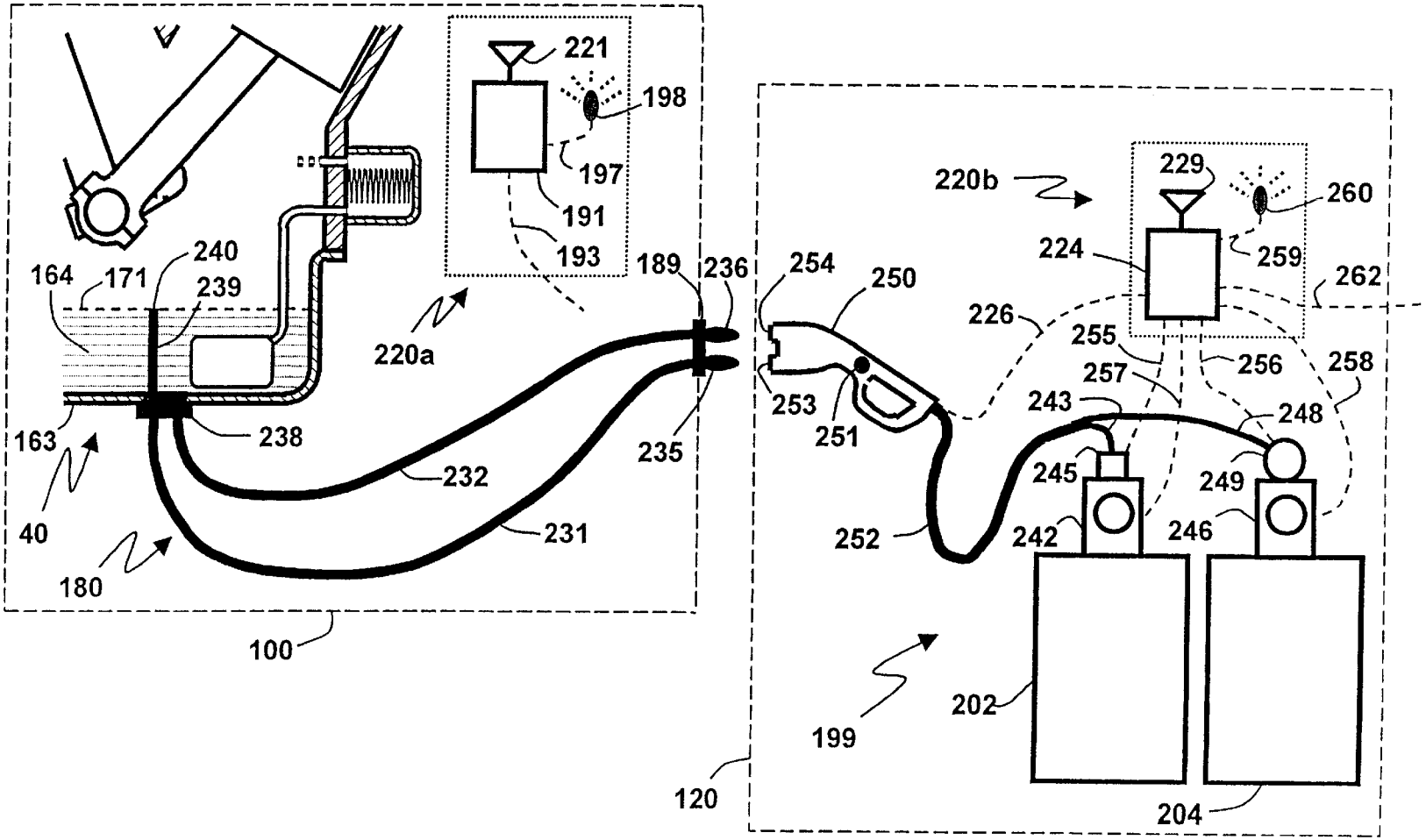

FIG. 14 shows another embodiment of a fluid maintenance system for maintaining the quality and level of engine oil 164 in engine 40 of apparatus 100. This embodiment includes on-apparatus sub-system 180 that includes conduits 231 and 232 and associated oil connectors 235 and 236, oil reservoir fitting 238 and overflow tube 239. Oil connectors 235, 236 are mounted at port 189 on apparatus 100 and are designed and constructed such that fluid can flow through the connectors only when connected to appropriate mating connectors. Oil reservoir fitting 238 allows conduit 232 to communicate with oil reservoir 163 and conduit 231 to communicate with overflow tube 239. Overflow tube 239 has opening 240 at the manufacturer's recommended oil level 171. The off-apparatus sub-system 199 at fluid maintenance facility 120 includes: used oil reservoir 202 with associated pump 242, hose 243 and oil sensing unit 245; maintenance oil reservoir 204 with associated pump 246, hose 248 and meter 249; nozzle assembly 250 with switch 251 and hose 252. Hose 252 has two separate conduits (not shown) that communicate with the conduits in hoses 243 and 248, and that terminate at connectors 253 and 254 respectively on nozzle assembly 250. Normally closed connectors 253 and 254 are designed and positioned on nozzle assembly 250 to mate in a leak-free manner with connectors 235 and 236 at port 189 of apparatus 100 such that on-apparatus conduit 231 only communicates through hoses 252 and 243, with oil sensing unit 245, pump 242 and used oil reservoir 202, and on-apparatus conduit 232 only communicates through hoses 252 and 248, with meter 249, pump 246 and maintenance oil reservoir 204.

Oil sensing unit 245 determines when used oil, and not air, is flowing from on-apparatus oil reservoir 163, and determines the quality of the used oil from apparatus 100. While electronic module 191 on apparatus 100 determines oil quality, that quality may be based only on engine/apparatus use and/or condition information, and even if oil condition information is used in the determination by module 191, that information may not be based on sensors that detect all failure modes of engine oil 164. Sensing unit 245 is designed to provide a more complete analysis of the condition of used oil removed from an apparatus.

The fluid maintenance system also includes a control means that has two controllers, on-apparatus controller 220*a* and off-apparatus controller 220*b*. On-apparatus controller 220*a* includes electronic module 191 with input wire 193 from oil quality, engine/apparatus use and/or condition sensors (not shown), output wire 197 to signaling device 198, and RF communication means 221. Off-apparatus controller 220*b*, mounted at fluid maintenance facility 120, includes electronic module 224, input 226 from switch 251 on nozzle assembly 250, input 255 from oil sensing unit 245, input 256 from meter 249, outputs 257 and 258 to pumps 242 and 246 respectively, output 259 to signaling device 260, communication wire 262 to a remote reporting location, and RF communication means 229.

Communication wire or conduit 262 allows electronic module 220*b* to communicate with a location remote from fluid maintenance facility 120 to obtain information about a particular apparatus that is useful in maintaining the oil of that apparatus. If fluid maintenance facility 120 is fixed, conduit 262 can be a continuous communication conduit, for example a wire to the remote location, or if fluid maintenance facility is mobile, conduit 262 can be a RF communication means (not shown) for communicating with a remote location.

In operation, when electronic module 191, using input 193, determines that apparatus 100 requires engine oil maintenance, signaling device 198 is turned "on". When a service technician or the apparatus operator observes signaling device 198 "on", apparatus 100 and fluid service facility 120 are brought together, connectors 253 and 254 of nozzle assembly 250 are properly mated to connectors 235 and 236 at port 189, and switch 251 is turned "on". Switch 251 powers electronic module 224 to communicate, using RF means 229 and 221, with electronic module 191. Electronic module 191 of controller 220*a* communicates the identity of and other relevant information about apparatus 100 and the volume of maintenance oil to be added to maintain the quality of engine oil 164 in engine oil reservoir 163. Using communication conduit 262, electronic module 224 of controller 220*b* communicates the apparatus 100 identity and relevant information to a remote location that contains maintenance information about apparatus 100 to determine if there is further information needed to maintain the engine oil of apparatus 100. As examples, electronic module 224 could receive: information about a change in oil maintenance requirements, historical information that shows oil maintenance trends, or information about a manufacturer's recall of apparatus 100 or one of the components of apparatus 100. Unless electronic module 224 receives information from the remote location not to maintain the oil of apparatus 100, the module powers pumps 242 and 246 "on" such that maintenance oil from reservoir 204 is pumped into the bottom of oil reservoir 163 and used oil 164 that overflows opening 240 in overflow tube 239 is pumped into used oil reservoir 202. The outlet of conduit 232 at fitting 238 is positioned or directed such that at the designed flow rate, the maintenance oil entering oil reservoir 163 does not quickly mix with used oil 164 near opening 240 of overflow tube 239. This is best accomplished if engine 40 was recently operating and oil 164 in oil reservoir 163 is warm. The warm used oil rises to the top of oil reservoir 163 as the relatively cooler maintenance oil is added near the bottom. Also the oil exchange needed to maintain oil quality should be typically less than 25% of the total volume of oil 164 in engine 40.

Electronic module 224 monitors the flow of maintenance oil with input 256 from meter 249 and monitors the flow of used oil with input 255 from oil sensing unit 245. As maintenance oil is added to oil reservoir 163, electronic module 224 determines the volume of oil 164 consumed or lost by engine 40 since the last oil maintenance when oil sensing unit 245 first detects flow of used oil 164 into opening 240 of overflow tube 239. When a sufficient volume of used oil 164 has flowed through oil sensing unit 245 to get a reliable oil quality measurement, electronic module 224 determines if the oil quality is above limits that are either predetermined, or were communicated by electronic module 191 of apparatus 100 or received from a remote location. If the used oil is not above the limits, electronic module 191 determines a new volume of maintenance fluid needed to maintain oil quality in engine 40 of apparatus 100. Only when the volume of maintenance oil pumped equals the ultimate volume determined by electronic module 224 using inputs from electronic module 191, communication conduit 262 and oil sensing unit 245 does electronic module 224 turn pump 246 "off" stopping the flow of maintenance oil into engine oil reservoir 163. When the flow of used oil 164 is no longer detected by sensing unit 245, electronic module 224 turns pump 242 "off", signals electronic module 191 to turn signaling device 198 "off", and, using communication conduit 262, communicates a report of engine oil maintenance information for apparatus 100 to remote location(s) for storage and/or analysis.

If information received from the remote location, or the used oil quality sensed by oil sensing unit 245 indicates that there may be a problem with engine 40, electronic module 224, using wire 259, turns signaling device 260 "on" to alert the service technician of the potential problem with engine 40 of apparatus 100, and a report communicated by electronic module 224 can include a maintenance warning.

Although not shown, electronic module 224 could incorporate an output to a visual display or to a printer to report the volume of maintenance oil added, the cost of the oil maintenance for apparatus 100, and/or details of any potential problem to the maintenance technician or apparatus operator.

When signaling device 198 is turned "off", the service technician turns switch 251 "off", removes nozzle assembly 250 from connectors 235, 236 at port 189, and apparatus 100 and fluid maintenance facility 120 are separated. The level and quality of engine oil 164 in engine 40 of apparatus 100 is maintained, and fluid maintenance facility 120 is ready to service another apparatus with sub systems 180 and 220*a* of this embodiment.

Figure 15:
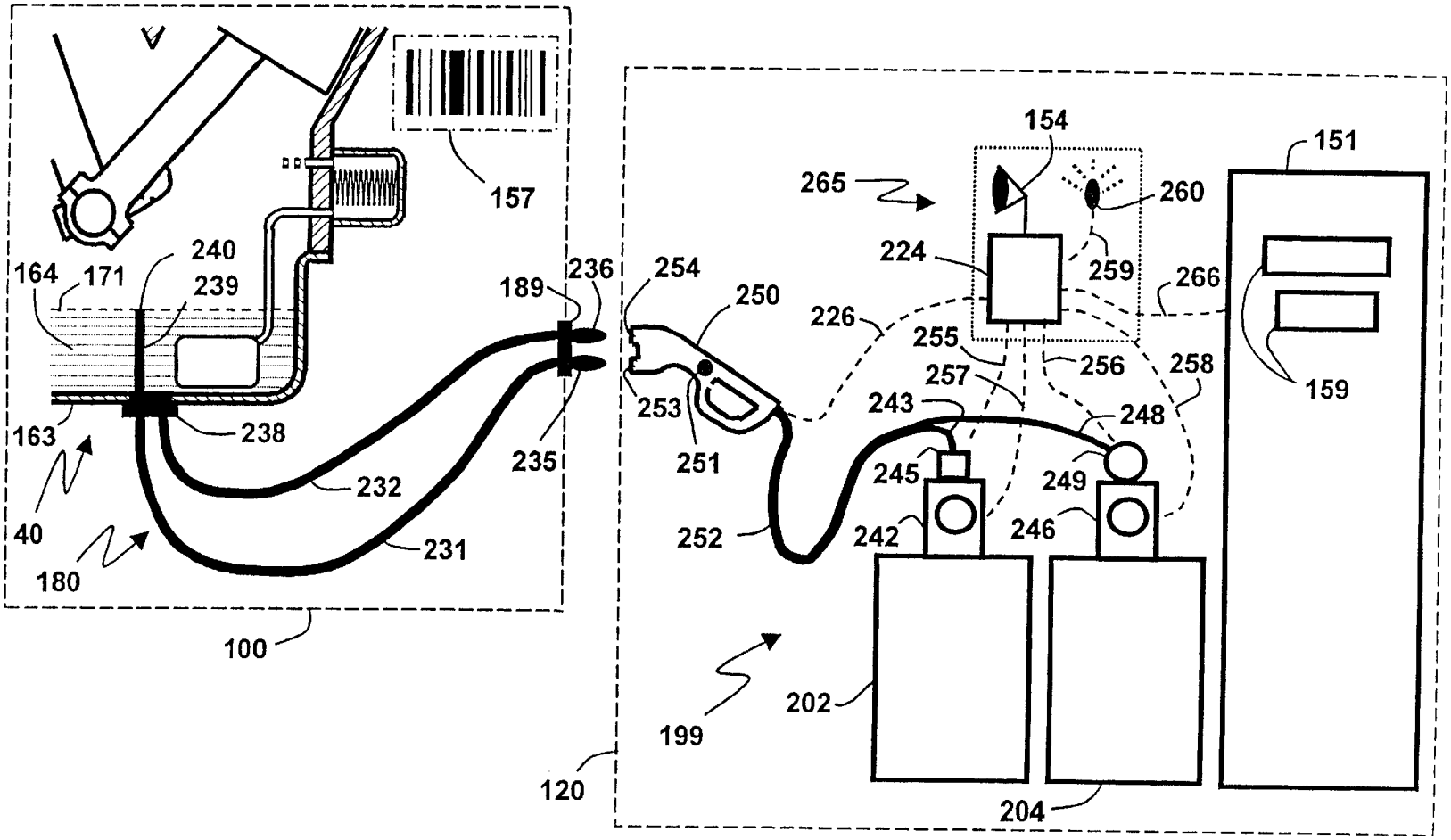

FIG. 15 shows another embodiment of a fluid maintenance system where fluid maintenance facility 120, either fixed or mobile, includes refueling system 151, previously shown in FIG. 10, which is used to refuel apparatus 100, and that is used in conjunction with the off-apparatus subsystem and controller to maintain the engine oil of apparatus 100. On-apparatus sub-system 180 and off-apparatus sub-system 199 are the same as shown in the embodiment of FIG. 14. Control means, located entirely at fluid maintenance facility 120, includes inputs 226, 255 and 256 from switch 251, oil sensing unit 245, and meter 249 respectively, outputs 257, 258 and 259 to used oil pump 242, maintenance oil pump 246 and signaling device 260 respectively, communication wire 266 to refueling system 151, and optical scanner 154. Optical scanner 154 is designed to read optical code 157 on apparatus 100.

In this embodiment, the engine/apparatus use parameter monitored by controller 224 to determine maintenance oil volume needed to maintain the quality of engine oil 164 in apparatus 100 is based on the amount of fuel added to apparatus 100 during refueling. That is, oil quality is maintained by adding a volume of maintenance oil that is a ratio of the fuel added during refueling. Optical code 157 of apparatus 100 either can directly include information about the oil-to-fuel ratio to be used by electronic module 224 of controller 265, or can include apparatus identification information that allows electronic module 224 to obtain the oil-to-fuel ratio from data that is either stored in electronic module 224 or stored at location(s) that can communicate with module 224 using communications wire or conduit 266 or other communication means (not shown).

In operation, when apparatus 100 and fluid maintenance facility 120 are brought together for periodic refueling of apparatus 100, controller 224, using optical scanner 154 to read optical code 157, determines the oil-to-fuel ratio for apparatus 100. A service technician or the operator of apparatus 100 mates a conduit (not shown) from fueling system 151 to a port on apparatus 100 (not shown) for refueling, and mates connectors 253 and 254 of nozzle assembly 250 to connectors 235, 236 at port 189. When refueling begins, electronic module 224 turns used oil pump 242 "on", and monitors communication conduit 266 for the amount of fuel being transferred by fueling system 151 and monitors input 256 from meter 249 to regulate power to pump 246 to achieve the determined oil-to-fuel ratio.

In this embodiment, as electronic module 224 monitors the volume of maintenance oil pumped, that information is communicated to refueling system 151 so that the volume and cost of maintenance oil can be included in the information displayed on visual outputs 159 of refueling system 151.

At the end of refueling, used oil pump 242 and maintenance oil pump 246 are turned "off". If the addition of maintenance oil during refueling has not caused sufficient used oil 164 to enter oil sensing unit 245 for oil quality sensing, or if the quality of the removed used oil 164 is outside either predetermined limits or limits communicated to electronic module 224 through communication conduit 266, electronic module 224 turns signaling device 260 "on" to alert the service technician that there may be a problem with engine 40 in apparatus 100.

If signaling device 260 is turned "on", the service technician can turn switch 251 on nozzle assembly 250 "on" to allow electronic module 224 to add additional maintenance oil to and remove used oil 164 from engine oil reservoir 163 to maintain oil quality and level. Electronic module 224 will turn signaling device 260 "off" after pumps 242 and 246 are both turned "off" at the end of this additional maintenance.

At the end of refueling or at the end of any additional oil maintenance, nozzle assembly 250 is removed from connectors 235, 236, and refueling conduit (not shown) is removed from apparatus 100. If optical code 157 includes the identity of apparatus 100, a record of the oil maintenance information can be stored in controller 265 for later downloading through a communication port (not shown), or can be communicated to remote location(s) using communication conduit 266 or another communication conduit (not shown). In this manner, engine oil quality is maintained each time that apparatus 100 is refueled.

The engine oil maintenance systems embodiments shown in FIGS. 12–15 maintain the quality of oil 164 in oil reservoir 163 but do not maintain the filtering element 170 of oil filter 66. FIGS. 16*a* and 16*b* show an invention embodiment that backflushes the engine oil filter to renew filtering capacity while maintaining the quality and level of engine oil of apparatus 100 during servicing at fluid maintenance facility 120.

Referring to FIG. 16*a,* off-apparatus sub-system 199 and controller 220*b* located at fluid maintenance facility 120 are the same as shown in the embodiment of FIG. 14. With the present invention embodiment, the conventional engine oil filter 66 of FIG. 11 is replaced with a backflushable oil filter assembly 270 that includes filter element 271, movable valve plate 272 and actuator 273. The on-apparatus fluid maintenance sub-system 180 also includes conduits 231, 232 and associated oil connectors 235, 236 at port 189, oil reservoir fitting 238 and overflow conduit 264. Connectors 235 and 236 are normally closed, thereby blocking flow through conduits 231 and 232 respectively, unless mated to appropriate connectors. Oil reservoir fitting 238 allows conduit 231 to communicate with oil reservoir 163. On apparatus controller 220*a* is similar to that of FIG. 14 with the added output wire 278 to power actuator 273.

In FIG. 16*a* movable valve plate 272 in filter assembly 270 is shown in the position held when engine 40 is normally operating. During such normal engine operation, oil pump 165 pumps oil 164 from oil reservoir 163, through conduit 166 and conduit 280 in valve plate 272, through filter element 271 in the direction shown by the arrow, through a second conduit 281 in valve plate 272, through conduit 167, ultimately applying oil 164 to moving components of engine 40. In this normal position, valve plate 272 prevents flow through conduits 232 and 264.

In FIG. 16*b* valve plate 272 is shown in position during engine oil maintenance. When switch 251 (FIG. 16*a*) of off-apparatus sub-system 199 is turned to "on", on-apparatus electronic module 191 communicates to off-apparatus electronic module 224 the larger of either the volume of maintenance oil needed to maintain the quality of engine oil 164, or the volume of oil needed to backflush filter assembly 270. As the information is being communicated, electronic module 191 applies power through wire 278 to actuator 273 to move valve plate 272 to the position shown in FIG. 16*b*. In this position, conduit 232 communicates with overflow conduit 264, such that oil entering opening 282 passes through conduit 264, through conduit 283 in valve plate 272, through filter element 271 of filter assembly 270 in the direction shown by the arrow, through another conduit 284 in valve plate 272, through conduit 232, and ultimately into used oil reservoir 202 of fluid maintenance facility 120 (FIG. 16*a*).

As maintenance oil is pumped into oil reservoir 163, used oil is pumped out of oil filter assembly 270. As the oil level in oil reservoir 163 rises above opening 282 of conduit 264, additional used oil backflushes filter element 271. Filter assembly 270 and filter element 271 are designed such that this backflushing renews the capacity of the filter for an appropriate period of engine operation.

Opening 282 of conduit 264 is positioned a fixed distance above the manufacturer's recommended level 171 so that the extra oil 164 in oil reservoir 163 at the end of the maintenance operation equals the oil volume needed to refill filter assembly 270. When the determined quantity of maintenance oil has been added and used oil removed, switch 251 (FIG. 16*a*) is turned "off", and electronic module 191 is instructed to reset, causing power to be removed from actuator 273, which returns valve plate 272 to the position shown in FIG. 16*a*. As with previous embodiments, at the end of servicing, volumes of fluid used and total cost may be displayed and reports issued. Also warnings may be given if an abnormal oil condition is sensed as before.

The invention embodiment shown in FIG. 16*a* and 16*b* show actuator 273 of on-apparatus sub-system 180 powered by wire 278 from electronic module 191 of on-apparatus controller 220*a*. Port 189 on apparatus 100, however, could include an additional connector (not shown) with a power conduit (not shown) to actuator 273, and nozzle 250 of off-apparatus subsystem 199 could include an additional connector (not shown) with a power conduit (not shown) to off-apparatus controller 220*b* such that off-apparatus electronic module 224 can directly power actuator 273 during engine oil maintenance.

FIGS. 17*a* and 17*b* show an invention embodiment that uses clean air to backflush the air filter element of an engine in apparatus 100 to renew filtering capacity during servicing at fluid maintenance facility 120. Engine 40 has air filter 58, including filter element 160, that attaches at intake manifold opening 286. The fluid maintenance system includes on-apparatus sub-system 288 with conduit 289 and associated connector 291, air filter fitting 293, movable valve plate 295 and actuator 297. Connector 291 is normally closed, thereby blocking flow through conduit 289 unless mated to an appropriate connector. Air-filter fitting 293 is mounted on air filter 58, and allows conduit 289 to communicate with air filter 58 between filter element 160 and engine intake manifold opening 286. Movable valve plate 295 mounts at intake manifold opening 286 to allow or to block the flow of air into the opening. Actuator 297 controls the position of valve plate 295.

On-apparatus controller 220*a* includes electronic module 191, input wire 193 from air quality, engine/apparatus use and/or condition sensors (not shown), output wire 197 to signaling device 198, output wire 299 to actuator 297, and RF communication means 221.

Fluid maintenance sub-system 199 at fluid maintenance location 200 includes air compressor 301, pressurized air storage reservoir 303, valve 305, hose 307, and nozzle 309 with switch 311. Air compressor 301 is normally "on" to maintain the pressure of clean, dry and oil free air in storage reservoir 303 within a predetermined range. Valve 305, which is normally "closed", controls the flow of pressurized air from air reservoir 303, through hose 307, to nozzle 309. Nozzle 309 mates in a leak free manner with connector 291 at port 189 on apparatus 100. Controller 220*b* at fluid maintenance facility 120 includes electronic module 224, input wire 313 from switch 311, output wire 315 to valve 305 and RF communication means 229.

In FIG. 17*a* movable valve plate 295 is shown in the position held when engine 40 is normally operating. During such normal engine operation, air enters air filter 58, through filter element 160 in the direction shown by the arrow, past valve plate 295 and into intake manifold opening 286. When electronic module 191 of on-vehicle controller 220a determines, using input 193, that the quality of air entering intake-manifold opening 286 is below a predetermined quality level, signaling device 198 is turned "on". For example, input 193 could be the pressure drop across filter element 160, and electronic module 191 turns signaling device 198 "on" when the pressure drop exceeds a predetermined limit. With signaling device 198 "on", apparatus 100 and fluid maintenance facility 120 are brought together, engine 40, if not already "off", is turned "off", nozzle 309 is properly mated to connector 291 at port 189, and switch 311 is turned "on". Turning switch 311 "on" powers electronic module 224 to communicate with electronic module 191 to determine the duration of pressurized air flow that must be applied to properly backflush filter element 160 of air filter 58, and to command electronic module 191 to power actuator 297 to move valve plate 295 to the "closed" position shown in FIG. 17*b,* thereby blocking the flow of air into intake manifold opening 286. Electronic module 224 then powers valve 305 "on" allowing the flow of pressurized air from air reservoir 303 into air filter 58 at fitting 293.

In FIG. 17*b* valve plate 295 is shown in the "closed" position held during maintenance of air filter 58. The pressurized clean air from air reservoir 303 is blown through filter element 160 and out filter 58 in the direction shown by the arrow. Air filter 58 and filter element 160 are designed such that backflushing in this manner, for the time communicated by electronic module 191, renews the capacity of the filter for efficient engine operation.

Referring again to FIG. 17*a,* at the end of the air flow period communicated by electronic module 191, electronic module 224 powers valve 305 "off" and signals to controller 191 to turn power "off" to actuator 297, moving valve plate 295 to the "open" position and to turn signaling device 198 "off".

Observing signaling device 198 turned "off", the service technician turns switch 311 "off", removes nozzle 309 from connector 291 at port 189, and apparatus 100 and fluid maintenance facility 120 separate. In this manner, the quality of air entering engine 40 of apparatus 100 is maintained by renewing the filtering capacity of element 160 in air filter 58.

The control means of the invention embodiments shown in FIGS. 7–10 and 11–17 use electronic modules to determine the volume of maintenance fluid needed to maintain the apparatus fluid. The control means, however, need not be electronic.

FIG. 18 shows another invention embodiment that maintains the coolant level in overflow reservoir 64 of apparatus 100 during servicing. The coolant overflow reservoir 64 with coolant 315 communicates with an engine radiator (for example 60 of FIG. 5) through conduit 62. The level of coolant 315 in reservoir 64 varies dependent on coolant temperature of the engine and radiator. Under general operating conditions, the coolant level should be at or above level 317. The level of coolant 315 is conventionally checked either by an external visual observation, if reservoir 64 is translucent, or by opening cap 319 and looking inside. When the level of coolant is below level 317, cap 319 is removed from reservoir 64 and an appropriate volume of maintenance coolant is added.

In the FIG. 18 invention embodiment, sub-system 320 on apparatus 100 includes coolant connector 322 at port 324, and conduit 326. Connector 322 is normally closed preventing fluid flow, unless mated to an appropriate connector. The off-apparatus sub-system 330 at fluid maintenance facility 120 includes coolant reservoir 332, pump 334, hose 336 with meter 338, and nozzle 340 with switch 342. Nozzle 340 mates with on-apparatus connector 322 at port 324 in a leak free manner such that coolant can be pumped from coolant reservoir 332, through hose 336 and nozzle 340, and into conduit 326.

The control means in this embodiment has two controllers, controller 345*a* on apparatus 100 and controller 345*b* at fluid maintenance facility 120. Controller 345*a* includes one-way valve assembly 347 that allows fluid to flow through conduit 326 into reservoir 64 only if the level of coolant 315 is below level 317, and does not allow the flow of coolant out of reservoir 64 through the valve assembly. Controller 345*b* includes electronic module 350, optical scanner 154, signaling device 352, output wires 354 and 356 to signaling device 352 and pump 334 respectively, input wires 358 and 360 from meter 338 and switch 342 respectively, and communication wire 362.

Optical scanner 154 is designed to read optical code 157 on apparatus 100. Communication wire or conduit 362 allows electronic module 350 to communicate with a location remote from the fluid maintenance facility 120 to obtain and/or report information that is useful for the maintenance of coolant 315 of apparatus 100.

In operation, apparatus 100 and fluid maintenance facility 120 are brought together, for example, as part of a regular fluid maintenance practice or for maintenance of another fluid. A service technician or the apparatus operator mates nozzle 340 to connector 322 at apparatus port 324, and turns switch 343 "on". Optical scanner 154 of off-apparatus controller 345*b* reads optical code 157 to identify apparatus 100, and electronic module 350 powers pump 334 and signaling device 352 "on". Coolant from off-apparatus sub-system 330 is pumped into on-apparatus sub-system 320 only when controller 345*a* determines that the level of coolant 315 is below level 317. If reservoir 64 does not require coolant, electronic module 350 turns signaling device 352 "off". If reservoir 64 requires coolant, electronic module 350 monitors the volume of coolant added using meter 338 and obtains historical coolant maintenance information either stored in electronic module 350 or from a remote location using communication conduit 362 and identification information obtained from optical code 157. When coolant replenishment is complete, if apparatus 100 required greater than a predetermined volume of coolant or if historical coolant maintenance information for apparatus 100 indicates a trend for increasing coolant additions, electronic module 350 intermittently powers signaling device 352 to alert a maintenance technician or apparatus operator that the cooling system of apparatus 100 may be in need of repair.

The service technician or apparatus operator observing signaling device 352 "off" or intermittently "on", turns switch 342 "off" which causes electronic module 350 to turn pump 334 and, if not already "off", signaling device 352 "off", and to either internally store a record, or communicate, using communication conduit 362, a report of the coolant maintenance information to remote location(s). If electronic module 350 has diagnosed that the cooling system of apparatus 100 may be in need of repair, a report communicated by the module can be to schedule repair at an apparatus repair facility.

Fluids other than coolant can be replenished, and maintenance information recorded with apparatus similar to that of FIG. 18, for examples, windshield cleaning fluid, metalworking fluid, and hydraulic fluid.

While particular embodiments of the present invention have been shown and described, it is apparent that various combinations, changes and modifications may be made therein to fit the fluid maintenance needs of individual apparatus or a multitude of apparatus without departing from the invention in its broadest aspects. In particular, with regard to the various functions performed by the above described systems, the terms (including any reference to a "means") used to describe such system are intended to correspond, unless otherwise indicated, to any sub-system or component which performs the specified function of the described sub-system or component (e.g., that is functionally equivalent), even though not structurally equivalent to the described sub-system or component which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A system for periodically maintaining at least one non-fuel fluid of an apparatus for proper operation comprising a first sub-system mounted on the apparatus for providing fluid communication between an apparatus fluid communication port and an apparatus component that requires non-fuel fluid, a second sub-system mounted at an off-apparatus fluid maintenance facility for providing a supply of maintenance fluid for a multitude of apparatus equipped with the first sub-system and for communicating the supply of maintenance fluid to the port on the apparatus, and control means for determining the quantity of the maintenance fluid to be supplied by the second sub-system to the first sub-system to maintain the non-fuel fluid, and for controlling fluid communication of the maintenance fluid from the second sub-system to the first sub-system during maintenance of the non-fuel fluid.

2. The system of claim 1 wherein the fluid maintenance facility is fixed and the apparatus are brought to the fluid maintenance facility for fluid maintenance.

3. The system of claim 1 wherein the fluid maintenance facility is mobile and is brought to the apparatus for fluid maintenance.

4. The system of claim 1 wherein the non-fuel fluid is at least one of the following: liquid, gas, semi-solid, particulate that can be fluidized.

5. The system of claim 1 wherein the non-fuel fluid is at least one of the following: engine oil, gear lubricant, metalworking fluid, hydraulic fluid, coolant, transmission fluid, brake fluid, cleaning fluid, air, nitrogen, oxygen, carbon dioxide, refrigerant, grease, fluidized abrasive, electric charge.

6. The system of claim 1 wherein the non-fuel fluid is maintained by replenishing at least a portion of the non-fuel fluid with the maintenance fluid.

7. The system of claim 6 wherein the maintenance fluid comprises at least one of the following: a fluid that is substantially the same as the non-fuel fluid being replenished, a fluid that is specially formulated as a replenishment fluid for the non-fuel fluid.

8. The system of claim 1 wherein the non-fuel fluid is maintained by renewing the non-fuel fluid with the addition of a maintenance fluid that has at least one additive that improves the fluid performance of the non-fuel fluid, the additive including at least one of the following: corrosion inhibitor, viscosity modifier, dispersant, friction modifier, coolant inhibitor, surfactant, detergent, extreme pressure agent.

9. The system of claim 1 wherein the non-fuel fluid is maintained by renewing a contaminant removal device that cleans the non-fuel fluid while the apparatus operates between periodic fluid maintenance.

10. The system of claim 9 wherein the contaminant removal device comprises a filter that is renewed by at least one of the following: backflushing with the non-fuel fluid as the non-fuel fluid is removed from the apparatus during fluid maintenance, flushing with a cleaning maintenance fluid that is communicated from a reservoir at the fluid maintenance facility.

11. The system of claim 1 wherein the control means determines the volume of maintenance fluid to be supplied to the apparatus during fluid maintenance based on at least one of the following non-fuel fluid conditions: level, contamination amount, contamination type, viscosity, electrical property, optical property.

12. The system of claim 1 wherein the control means determines the volume of maintenance fluid to be supplied to the apparatus during fluid maintenance based on at least one of the following: apparatus use, apparatus condition, a combination of non-fuel fluid condition, apparatus use and apparatus condition.

13. The system of claim 12 wherein apparatus use includes at least one of the following: time of operation, number of operations, distance traveled, fuel use.

14. The system of claim 12 wherein apparatus condition is based on efficiency of apparatus operation.

15. The system of claim 1 wherein the control means further comprises means for determining the kind, type and grade of the maintenance fluid to be used with a particular apparatus.

16. The system of claim 1 wherein the control means further comprises means for identifying a particular apparatus during fluid maintenance.

17. The system of claim 1 wherein the control means further comprises means for recording and storing fluid maintenance information for the particular apparatus for later retrieval.

18. The system of claim 1 wherein the control means is on the apparatus and communicates information to the fluid maintenance facility needed to control the second sub-system.

19. The system of claim 1 wherein the control means is located at the fluid maintenance facility and communicates information to the apparatus needed to control the first sub-system.

20. The system of claim 1 wherein the control means is located in part on the apparatus and in part at the fluid maintenance facility, with communication means between the apparatus and the fluid maintenance facility.

21. The system of claim 1 wherein engine oil is the non-fuel fluid that is periodically maintained, the first sub-system provides fluid communication between the apparatus port and an engine oil reservoir of the apparatus, the second sub-system includes a maintenance oil reservoir for providing a supply of maintenance oil and a used oil reservoir for receiving used engine oil to and from the engine oil reservoir, and the control means controls the level and quality of the engine oil in the engine oil reservoir during fluid maintenance.

22. The system of claim 21 wherein the first sub-system includes an overflow in the engine oil reservoir which communicates any excess used engine oil to the used oil reservoir.

23. The system of claim 22 wherein the first sub-system includes a backflushable oil filter assembly, and means for causing the excess used engine oil that is removed from the engine oil reservoir to flow back through the oil filter assembly prior to being communicated to the used oil reservoir.

24. The system of claim 23 wherein the means for causing the excess used engine oil to flow back through the filter assembly includes an overflow that is positioned a predetermined distance above a manufacturer's recommended engine oil level in the engine oil reservoir such that the added volume of maintenance oil to the engine oil reservoir is equivalent to the volume of engine oil needed to refill the filter assembly at the end of oil maintenance.

25. The system of claim 1 further comprising at least one display for displaying at least one of the following: the volumes of maintenance fluid communicated by the second sub-system during the maintenance of the non-fuel fluid, the cost of maintenance provided.

26. The system of claim 1 further comprising a printer for providing a report with maintenance information at the end of fluid maintenance.

27. The system of claim 1 wherein lubrication grease is the non-fuel fluid that is periodically maintained and the first sub-system distributes grease supplied to the apparatus port to at least one apparatus component requiring lubrication grease, and the second sub-system includes a grease reservoir for supplying lubrication grease to the apparatus port during fluid maintenance.

28. The system of claim 27 wherein the control means includes means for measuring the pressure of the lubrication grease supplied to the first sub-system by the second sub-system, and if the pressure is outside a predetermined range, giving a warning of a possible component or system failure.

29. The system of claim 1 wherein there are a plurality of first sub-systems mounted on the apparatus, each of the first sub-systems including means for providing fluid communication between at least one apparatus fluid communication port and a plurality of apparatus components that require non-fuel fluid for proper operation, and the second sub-system includes a plurality of reservoirs, and means for communicating maintenance fluid between the reservoirs and the first sub-systems on the apparatus, and at least one control means for controlling the process of maintaining the non-fuel fluids by determining the quantity of a plurality of maintenance fluid communications between the first sub-systems and the second sub-system to maintain the non-fuel fluids, and by controlling the maintenance fluids communications between the first sub-systems and the second sub-system during maintenance of the non-fuel fluids.

30. The system of claim 29 wherein the apparatus includes a single port for communicating more than one maintenance fluid, the port having multiple connectors communicating with multiple first sub-systems, and the second sub-system including a hose with multiple conduits and a hose nozzle containing multiple connectors oriented for establishing communication between the connectors of the first sub-systems and the appropriate fluid reservoirs at the second sub-system.

31. The system of claim 29 wherein the apparatus includes a plurality of ports for communicating more than one maintenance fluid.

32. A system for periodically maintaining a non-fuel fluid of a component mounted on an apparatus comprising an on-apparatus sub-system for providing fluid communication with the apparatus component, an off-apparatus supply of maintenance fluid, communication means for selectively providing communication between the off-apparatus supply and the on-apparatus sub-system, and control means for determining when and the volume of maintenance fluid to be supplied to the on-apparatus sub-system and for controlling the periodic transfer of the maintenance fluid to the on-apparatus sub-system for maintaining the level and quality of non-fuel fluid of the on-apparatus component.

33. The system of claim 32 wherein the apparatus includes a plurality of on-apparatus sub-systems for providing fluid communication with a plurality of apparatus components requiring non-fuel fluids for proper operation, and a single port for intermittent volume transfer of a plurality of maintenance fluids from the off-apparatus supply to a plurality of the on-apparatus sub-systems.

34. The system of claim 32 wherein the apparatus includes means for providing for the periodic volume transfer of maintenance fluid to the on-apparatus sub-system from an off-apparatus fluid maintenance facility and used fluid from the on-apparatus sub-system to the off-apparatus service facility.

35. The system of claim 32 wherein the control means determines the volume of fluid to be supplied to the apparatus sub-system based on preselected apparatus use or performance.

36. The system of claim 32 further comprising on-apparatus means for identifying a particular apparatus and kind, type and grade of non-fuel fluids to be used with the apparatus.

37. The system of claim 32 further comprising means for communicating information regarding fluid maintenance of a particular apparatus between the control means and a remote location.

38. A system for periodically replenishing or replacing one or more non-fuel fluids of an apparatus comprising an off-apparatus dispenser for dispensing fluids, means for establishing fluid communication between the dispenser and an on-apparatus sub-system that supplies fluid to one or more apparatus components that require non-fuel fluid, and control means for determining the amount of non-fuel fluid to be replenished or replaced and actuating the dispenser to dispense the required amount of fluid to the sub-system during fluid maintenance.

39. The system of claim 38 wherein the means for establishing fluid communication between the dispenser and the sub-system comprises an apparatus port in fluid communication with the sub-system and a dispenser hose that is connected to the apparatus port during fluid maintenance, the apparatus port having multiple openings, and the hose having multiple conduits communicating with multiple off-apparatus reservoirs through the dispenser and a nozzle on the hose containing multiple connectors oriented for establishing communication with respective ones of the openings at the apparatus port when the nozzle is connected to the apparatus port.

40. The system of claim 39 wherein the sub-system includes an engine oil reservoir, and off-apparatus reservoirs provide a supply of maintenance oil to the engine oil reservoir and receive used engine oil from the engine oil reservoir, respectively.

41. The system of claim 38 wherein the sub-system includes an engine oil reservoir, and the dispenser includes off-apparatus reservoirs containing a supply of maintenance oil and for storing used engine oil, respectively, the dispenser being operated by the control means to maintain the level and quality of engine oil in the engine oil reservoir during fluid maintenance.

42. The system of claim 41 further comprising on-apparatus sensors for determining the quality of the engine oil in the engine oil reservoir, and means for transmitting information regarding engine oil quality from the on-apparatus sensors to the control means for use in determining the amount of maintenance oil to be added to the engine oil reservoir by the dispenser to maintain engine oil quality.

43. The system of claim 41 further comprising on-apparatus electronic means for receiving information from the control means based on an algorithm to determine engine oil quality and transmitting such engine oil quality information back to the control means for use in determining the volume of maintenance oil to be added to the engine oil reservoir by the dispenser during fluid maintenance to maintain engine oil quality.

44. The system of claim 41 further comprising on-apparatus sensors for monitoring engine performance of a particular apparatus since the last engine oil maintenance of the particular apparatus to determine engine oil quality, and means for transmitting information regarding the engine oil quality to the control means for use in determining the amount of maintenance oil to be added to the engine oil reservoir by the dispenser to maintain engine oil quality of the particular apparatus.

45. The system of claim 41 further comprising means for storing information concerning the amount of maintenance oil last added to the engine oil reservoir of a particular apparatus and communicating such information to the control means for use in determining the amount of maintenance oil to be added to the engine oil reservoir of the particular apparatus by the dispenser during the next fluid maintenance to maintain engine oil quality.

46. The system of claim 41 further comprising an overflow tube in which any excess used engine oil in the engine oil reservoir is pumped into the off-apparatus used engine oil reservoir.

47. The system of claim 46 wherein the apparatus includes a backflushable oil filter assembly, and means for causing any excess used engine oil that is pumped out of the engine oil reservoir to flow back through the oil filter assembly prior to being pumped into the off-apparatus used engine oil reservoir.

48. The system of claim 47 wherein the overflow tube is positioned a predetermined distance above a manufacturer's recommended engine oil level in the engine oil reservoir equivalent to the volume of maintenance oil needed to refill the filter assembly at the end of the oil maintenance operation.

49. The system of claim 38 further comprising communication means for sending a report to a remote location detailing the action taken during fluid maintenance.

50. The system of claim 38 wherein the non-fuel fluid is a coolant, further comprising an on-apparatus coolant overflow reservoir and an off-apparatus reservoir containing a fresh supply of coolant, the dispenser being operated by the control means during fluid maintenance to cause coolant to flow from the off-apparatus reservoir to the on-apparatus coolant overflow reservoir if the coolant in the on-apparatus coolant overflow reservoir is below a predetermined level.

51. The system of claim 50 further comprising an apparatus port having an inlet in fluid communication with the apparatus coolant overflow reservoir, and a hose in fluid communication with the dispenser that is connectable to the apparatus port, the dispenser being operated by the control means to cause coolant to flow from the off-apparatus coolant reservoir through the hose to the apparatus port and coolant inlet to the coolant overflow reservoir during fluid maintenance.

52. The system of claim 51 further comprising a one-way valve assembly in fluid communication with the coolant inlet that only allows coolant flow through the coolant inlet into the coolant overflow reservoir.

53. The system of claim 38 wherein the sub-system is a grease distribution sub-system for distributing grease supplied to an apparatus port to a plurality of on-apparatus components requiring lubrication, and the system includes an off-apparatus grease supply, the dispenser being operable by the control means to cause a predetermined amount of grease to flow from the off-apparatus grease supply to the on-apparatus port for distribution by the grease distribution sub-system to the apparatus components as determined by the grease requirements of the individual apparatus components.

54. The system of claim 53 wherein the grease distribution sub-system is in fluid communication with the apparatus port, and the dispenser has a hose connectable to the apparatus port, the dispenser being operated by the control means to cause grease to flow from the off-apparatus grease supply through the hose to the apparatus port and into the grease distribution sub-system for distribution to the apparatus components.

55. The system of claim 54 further comprising communication means between the apparatus and control means for communicating the grease requirements of the apparatus components.

56. The system of claim 54 further comprising means for measuring the pressure of the grease being supplied to the grease distribution sub-system by the dispenser, and if the pressure is higher or lower than expected, giving a warning of a possible blockage of any of the apparatus components or a possible break in any grease lines in the system.

57. The system of claim 38 wherein the non-fuel fluid is a windshield cleaning fluid, further comprising an on-apparatus windshield cleaning fluid reservoir, and an off-apparatus reservoir containing a supply of windshield cleaning fluid, the dispenser being operable by the control means during fluid maintenance to cause windshield cleaning fluid to flow from the off-apparatus windshield cleaning fluid reservoir to the on-apparatus windshield cleaning reservoir if the windshield cleaning fluid in the on-apparatus windshield cleaning fluid reservoir is below a predetermined level.

58. The system of claim 57 wherein the on-apparatus windshield cleaning fluid reservoir is in fluid communication with an apparatus port, and the dispenser includes a hose that is connectable to the apparatus port during fluid maintenance, the dispenser being operable to cause windshield cleaning fluid to flow from the off-apparatus windshield cleaning fluid reservoir through the hose to the apparatus port and into the on-apparatus windshield cleaning fluid reservoir during fluid maintenance.

* * * * *